US006439181B1

(12) United States Patent
Fujiwaki et al.

(10) Patent No.: US 6,439,181 B1
(45) Date of Patent: Aug. 27, 2002

(54) VARIABLE VALVE TIMING SYSTEM

(75) Inventors: Kenji Fujiwaki, Kariya; Osamu Komazawa, Chita, both of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/963,394

(22) Filed: Sep. 27, 2001

(30) Foreign Application Priority Data

Sep. 27, 2000 (JP) ..... 2000-294919

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 6,053,139 A * 4/2000 Eguchi et al. ..... 123/90.17
6,058,897 A * 5/2000 Nakayoshi ..... 123/90.17
6,302,072 B1 * 10/2001 Sekiya et al. ..... 123/90.17

FOREIGN PATENT DOCUMENTS

JP 11-223112 8/1999

* cited by examiner

*Primary Examiner*—Weilun Lo
(74) *Attorney, Agent, or Firm*—Burns, Doane, Swecker & Mathis, LLP

(57) ABSTRACT

A variable valve timing system includes a relative rotation controlling mechanism restricting relative rotation of a housing member and a rotor member at the intermediate lock phase between the most advanced angle phase and the most retarded angle phase. An auxiliary controlling mechanism actuated in response to the operation fluid to be supplied to and discharged from a fluid pressure circuit allows the relative rotation of the housing member and the rotor member under the unlock condition and restricts the rotation of the rotor member to the retarded angle side or to the advanced angle side relative to the housing member at a set phase between the most retarded angle phase or the most advanced angle phase and the intermediate lock phase under the lock condition.

12 Claims, 20 Drawing Sheets

VARIABLE VALVE TIMING SYSTEM

This application is based on and claims priority under 35 U.S.C. §119 with respect to Japanese Application 2000-294919 filed on Sep. 27, 2000, the entire content of which is incorporated herein by reference.

FIELD OF THE INVENTION

This invention generally relates to a variable valve timing system of an internal combustion engine. More particularly, the present invention pertains to a variable valve timing system for controlling the opening and closing timing of an intake valve and an exhaust valve of an internal combustion engine.

BACKGROUND OF THE INVENTION

A known variable valve timing system is disclosed in Japanese Patent Laid-Open Publication No. HS1-223112 published on Aug. 17, 1999. The disclosed variable valve timing system includes a housing member rotating as a unit with a crankshaft (or a camshaft) of the internal combustion engine, and a rotor member rotating as a unit with the camshaft (or the crankshaft). The rotor member is rotatably assembled on a shoe portion provided at the housing member and forms an advanced angle chamber and a retarded angle chamber at a vane portion in the housing member. The variable valve timing system also includes a relative rotation controlling mechanism actuated in response to supply and discharge of the operation fluid. The relative rotation controlling mechanism allows the relative rotation of the housing member and the rotor member under an unlock condition and restricts the relative rotation of the housing member and the rotor member at a lock phase between a most advanced angle phase and a most retarded angle phase, excluding the most retarded angle phase (or the most advanced angle phase), under a lock condition. The variable valve timing system further includes a fluid pressure circuit for controlling the operation fluid to be supplied to and discharged from the advanced angle chamber, the retarded angle chamber, and the relative rotation controlling mechanism.

In this variable valve timing system, the relative rotation controlling mechanism is adapted to restrict the relative rotation of the housing member and the rotor member at the lock phase as an intermediate angle phase between the most advanced angle phase and the most retarded angle phase until the pressure of the operation fluid supplied from the fluid pressure circuit reaches a high enough pressure (i.e., until the relative rotation of the housing member and the rotor member can be maintained by the pressure of the operation fluid) when the internal combustion engine is started. If the relative rotation controlling mechanism is effectively operated at the starting of the internal combustion engine, the rotor member is not unnecessarily rotated relative to the housing member by torque fluctuations affecting the camshaft, and the occurrence of a hitting sound can be prevented. In addition, the appropriate and predetermined variable valve timing can be obtained for starting, thus improving the starting ability of the internal combustion engine.

When the housing member is integrally rotated with the crankshaft and the rotor member is integrally rotated with the camshaft with the above-described relative rotation controlling mechanism, the rotor member receives a large force to the retarded angle side relative to the housing member by the torque fluctuation affecting the camshaft. Thus when the relative rotation phase (designated in accordance with the condition when the internal combustion engine is stopped) of the housing member and the rotor member is positioned at the most advanced angle phase before the starting of the internal combustion engine, the relative rotation controlling mechanism is effectively operated as soon as the internal combustion engine is started and restricts the relative rotation of the housing member and the rotor member at the lock phase (intermediate advanced angle) as shown in FIG. 6 of the aforementioned published application. However, when the relative rotation phase of the housing member and the rotor member is positioned at the most retarded angle phase before the starting of the internal combustion engine, the relative rotation controlling mechanism requires a long time to be effectively operated after the combustion engine is started as shown in FIG. 7 of the aforementioned published application. The torque fluctuation torque caused by the cam rotates the camshaft toward the advanced angle side and toward the retarded angle side alternately. However, the torque fluctuation toward the retarded angle side is larger than toward the advanced angle side. The camshaft is thus finally rotated to the retarded angle side. Accordingly, when the relative rotation phase of the housing member and the rotor member is positioned at the most retarded angle phase before the starting of the internal combustion engine, the relative rotation controlling mechanism requires a long time to be effectively operated (or cannot be effectively operated) at the starting of the internal combustion engine. Thus, a hitting sound might occur and the starting ability of the internal combustion engine might be adversely affected.

The above described difficulties or defects might also occur when the above relative rotation controlling mechanism restricts the relative rotation of the housing member and the rotor member at the most advanced angle phase. In addition, when the housing member is integrally rotated with the camshaft and the rotor member is integrally rotated with the crankshaft, the housing member receives a large force to the retarded angle side relative to the rotor member by the torque fluctuation affecting the camshaft. Thus, under this condition and when the relative rotation phase of the housing member and the rotor member is positioned at the most advanced angle phase before the starting of the internal combustion engine, the relative rotation controlling mechanism requires a long time to be effectively operated at the starting of the internal combustion engine. Thus, a hitting sound might occur and the starting ability of the internal combustion engine might be adversely affected. The above described defects happen significantly when, for example, the friction is high under a low temperature.

A need thus exists for an improved variable valve timing system which is not as susceptible to the disadvantages and drawbacks discussed above.

SUMMARY OF THE INVENTION

According to one aspect of the present invention, a variable valve timing system for an internal combustion engine includes a housing member rotating as a unit with either a crankshaft or a camshaft of the internal combustion engine, and a rotor member relatively rotatably assembled on a shoe portion provided at the housing member and forming an advanced angle chamber and a retarded angle chamber at a vane portion in the housing member, with the rotor member rotating as a unit with either the camshaft or the crankshaft of the internal combustion engine. A relative rotation controlling mechanism is actuated in response to the supply and discharge of an operation fluid, and allows relative rotation of the housing member and the rotor member under an unlock condition while restricting relative rotation of the housing member and the rotor member at a lock phase between a most advanced angle phase and a most retarded angle phase, excluding the most retarded angle phase or the most advanced angle phase, under a lock condition. A fluid pressure circuit controls the operation fluid to be supplied to and discharged from the advanced angle chamber, the retarded angle chamber, and the relative rotation controlling mechanism. An auxiliary controlling mechanism is actuated in response to the operation fluid supplied to and discharged from the fluid pressure circuit, and allows relative rotation of the housing member and the rotor member under the unlock condition, and restricts the rotation of the rotor member to the retarded angle side or to the advanced angle side relative to the housing member at a set phase between the most retarded angle phase or the most advanced angle phase and the lock phase under the lock condition.

A biasing device is preferably provided for rotatably biasing the rotor member to the advanced angle side (or to the retarded angle side) relative to the housing member with a predetermined biasing force. The auxiliary controlling mechanism is preferably integrally assembled in the relative rotation controlling mechanism.

According to the variable valve timing system of this invention, at an early stage of the internal combustion engine starting, the operation fluid is not sufficiently discharged from the fluid pressure circuit to each advanced angle chamber, each retarded angle chamber, the relative rotation controlling mechanism, and the auxiliary controlling mechanism. Thus, the relative rotation phase of the rotor member to the housing member cannot be maintained by the pressure of the operation fluid. If the relative rotation phase of the rotor member and the housing member is not positioned at the lock phase, the housing member and the rotor member are relatively rotated by the torque fluctuation affecting to the camshaft.

The auxiliary controlling mechanism restricts the rotation of the rotor member only to the retarded angle side (or to the advanced angle side) relative to the housing member at the set phase between the most retarded angle phase (or the most advanced angle phase) and the lock phase under the lock condition. Accordingly, when the relative rotation phase of the housing member and the rotor member is varied from the most retarded angle phase (or the most advanced angle phase) to the set phase by the torque fluctuation affecting the camshaft, the auxiliary controlling mechanism comes into the lock condition. Then the auxiliary controlling mechanism restricts the rotation of the rotor member only to the retarded angle side (or to the advanced angle side) relative to the housing member, and the initial value of the relative rotation phase is held at the set phase.

Thus the relative rotation phase of the housing member and the rotor member is instantly varied to the lock phase afterwards by the torque fluctuation affecting the camshaft. Then, the relative rotation phase of the housing member and the rotor member is restricted at the lock phase by the relative rotation controlling mechanism. Accordingly, the time required for the relative rotation of the housing member and the rotor member to be restricted at the lock phase from the point of the internal combustion engine starting by the relative rotation controlling mechanism can be reduced. The occurrence of a hitting sound by the vane touching or contacting the projection is thus decreased and difficulties associated with the starting ability of the internal combustion engine can be reduced.

When the biasing device is provided for rotatably biasing the rotor member to the advanced angle side (or to the retarded angle side) relative to the housing member with a predetermined biasing force, the relative rotation of the housing member and the rotor member is varied to the advanced angle side (or to the retarded angle side) by the biasing force of the biasing device in addition to the torque fluctuation affecting the camshaft. Thus, the time required for the relative rotation of the housing member and the rotor member to be restricted at the lock phase from the point of the internal combustion engine starting by the relative rotation controlling mechanism can be further reduced. If the auxiliary controlling mechanism is integrally assembled in the relative rotation mechanism, the auxiliary controlling mechanism can be simply configured and the cost can be reduced.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
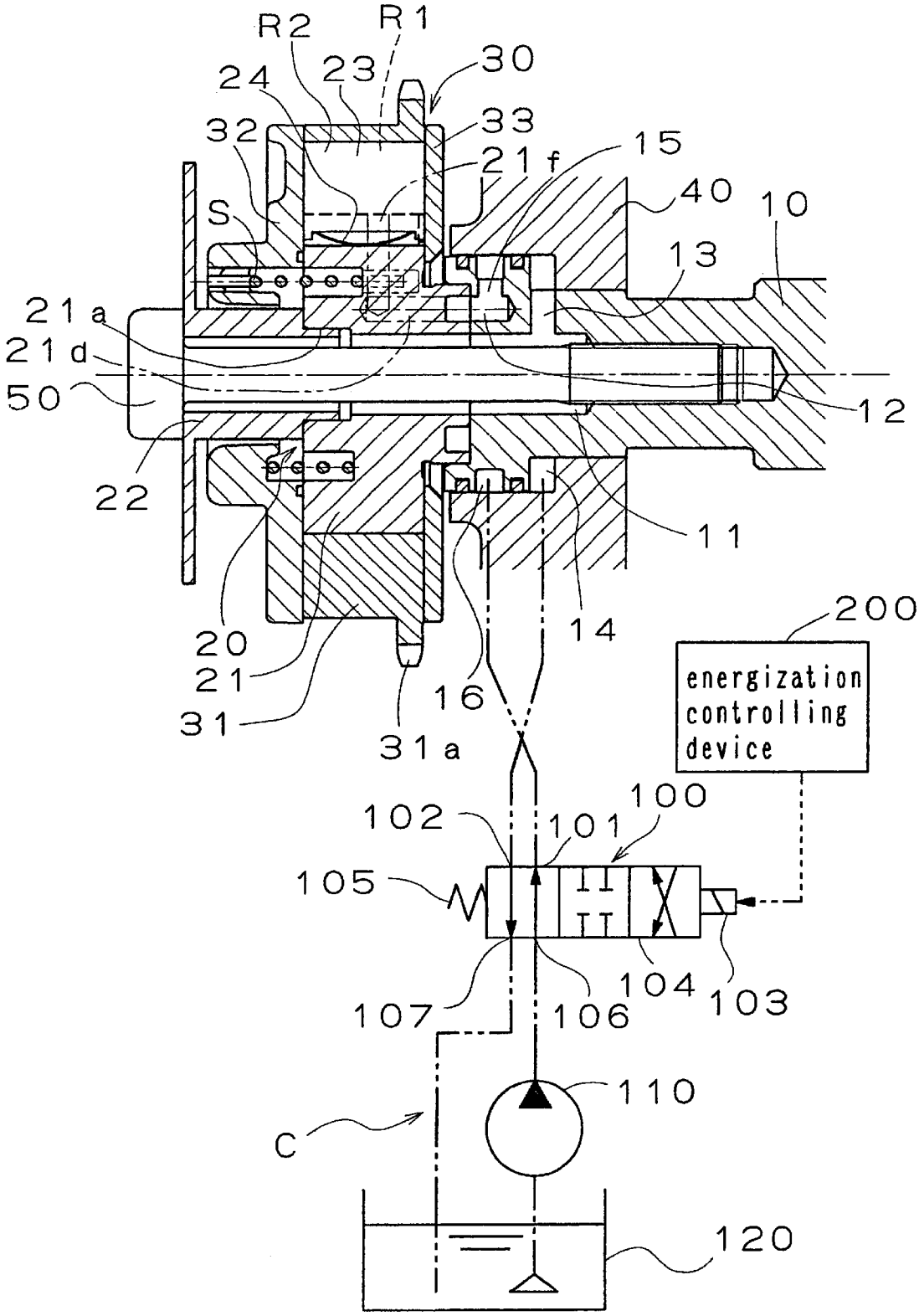
FIG. 1 is a schematic illustration of a variable valve timing system according to an embodiment of the present invention.

As shown in FIGS. 1–5, a first embodiment of the variable valve timing system includes a rotor member 20 assembled as a unit with an end portion (left side of FIG. 1) of a camshaft 10 in the internal combustion engine, a housing member 30 supported by the rotor member 20 and rotatable within a predetermined range, and a torsion spring S disposed between the housing member 30 and the rotor member 20.

The variable valve timing system also includes a first controlling mechanism Al and a second controlling mechanism A2 as a relative rotation controlling mechanism for restricting the relative rotation of the housing member 30 and the rotor member 20 at an intermediate lock phase under a lock condition. The variable valve timing system additionally includes an auxiliary controlling mechanism B for restricting the rotation of the rotor member 20 only to a retarded angle side relative to the housing member 30 at a set phase, which is on the retarded angle side from the intermediate lock phase, under a lock condition.

Further, the variable valve timing system includes a fluid pressure circuit C for controlling the operation fluid to be supplied to and discharged from an advanced angle chamber R1 and a retarded angle chamber R2 as well as for controlling the operation fluid to be supplied to and discharged from the first controlling mechanism A1, the second controlling mechanism A2, and the auxiliary controlling mechanism B.

The camshaft 10 having a well-known cam for controlling the opening and closing of an intake valve (not shown) is rotatably supported by a cylinder head 40 of the internal combustion engine. An advanced angle passage 11 and a retarded angle passage 12 are provided in the camshaft 10 and extend in the axial direction. The advanced angle passage 11 is connected with a connecting port 102 of a fluid pressure controlling valve 100 through a radially extending passage 13 and an annular passage 14. The retarded angle passage 12 is connected with a connecting port 101 of the fluid pressure controlling valve 100 through a radially extending passage 15 and an annular passage 16. The radially extending passages 13, 15 and the annular passage 16 are formed in the camshaft 10, and the annular passage 14 is formed in a stepped portion between the camshaft 10 and the cylinder head 40.

The rotor member 20 is provided with a main rotor 21 and a front rotor 22. The front rotor 22 is assembled on the front (left side of FIG. 1) of the main rotor 21 as a unit and has a cylindrical shape with a stepped portion. The rotor member 20 is engaged with a front end of the camshaft 10 as a unit by a bolt 50.

The central inner bores of the main rotor 21 and the front rotor 22 are connected with the advanced angle passage 11 provided in the camshaft 10 while being blocked by a head portion of the bolt 50 at the front end.

The main rotor 21 is provided with an inner bore 21*a* coaxially assembled with the front rotor 22, and four vane grooves 21*b* for receiving respective vanes 23. A spring 24 (shown in FIG. 1) is provided and biases the four vanes 23 outward in the radial direction. Each vane 23 assembled in the respective vane groove 21*b* extends outward in the radial direction and forms the advanced angle chamber R1 and the retarded angle chamber R2 in the housing member 30.

The main rotor 21 includes three radially extending passages 21*c* in communication with the advanced angle passage 11 at the radial inner end through the central inner bore and in communication with the respective advanced angle chambers R1 at the radial outer end. The main rotor 21 also includes a radially extending passage 21*d* in communication with the advanced angle passage 11 at the radial inner end through the central inner bore and in communication with the advanced angle chamber R1 at the radial outer end through the first controlling mechanism A1 and a passage P1.

The main rotor 21 further includes four axially extending passages 21*e* in communication with the retarded angle passage 12, and two radially extending, passages 21*f* in communication with the respective passages 21*e* at the radial inner end and in communication with the respective retarded angle chambers R2 at the radial outer end. Moreover, the main rotor 21 includes a radially extending passage 21*g* in communication with the passage 21*e* at the radial inner end and in communication with the retarded angle chamber R2 at the radial outer end through the second controlling mechanism A2 and a passage P2. Finally, the main rotor 21 includes a radially extending passage 21*h* in communication with the passage 21*e* at the radial inner end and in communication with the retarded angle chamber R2 at the radial outer end through the auxiliary controlling mechanism B.

The housing member 30 is provided with a housing body 31, a front plate 32, and a rear thin plate 33. Four bolts 34 (shown in FIG. 2) are provided to connect the housing body 31, the front plate 32 and the rear thin plate 33 as a unit. The outer periphery of the housing body 31 is provided with a sprocket 31*a* . The sprocket 31*a* is connected with a crankshaft of the internal combustion engine through a timing chain and is rotated in the clockwise direction of FIG. 2 by the driving force transmitted from the crankshaft.

Figure 2:
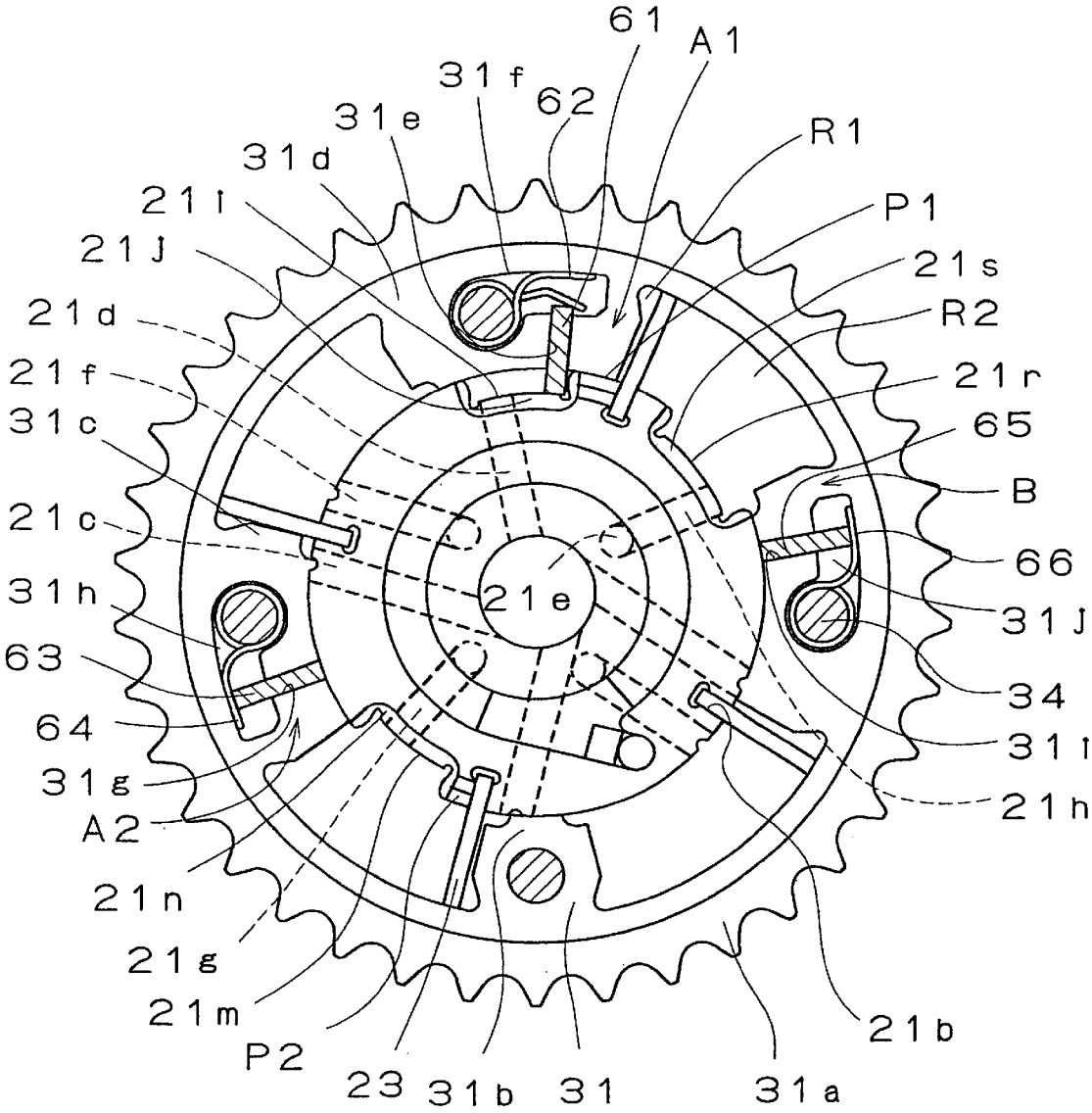
FIG. 2 is a cross-sectional view of a portion of the variable valve timing system shown in FIG. 1 as viewed from the front.

The housing body 31 is provided with four shoe portions 31*b* projecting inward in the radial direction and rotatably supporting the main rotor 21 at the radial inner end of each shoe portion 31*b*. The axially opposing end surfaces of the front plate 32 and the rear thin plate 33 are slidably in contact with the outer peripheral end surfaces of the main rotor 21 and the end surfaces of the vanes 23. As shown in FIG. 2, the housing body 31 is also provided with projections 31*c* defining the most retarded angle phase and projections 31*d* defining the most advanced angle phase through contact with the vanes 23.

Figure 4:
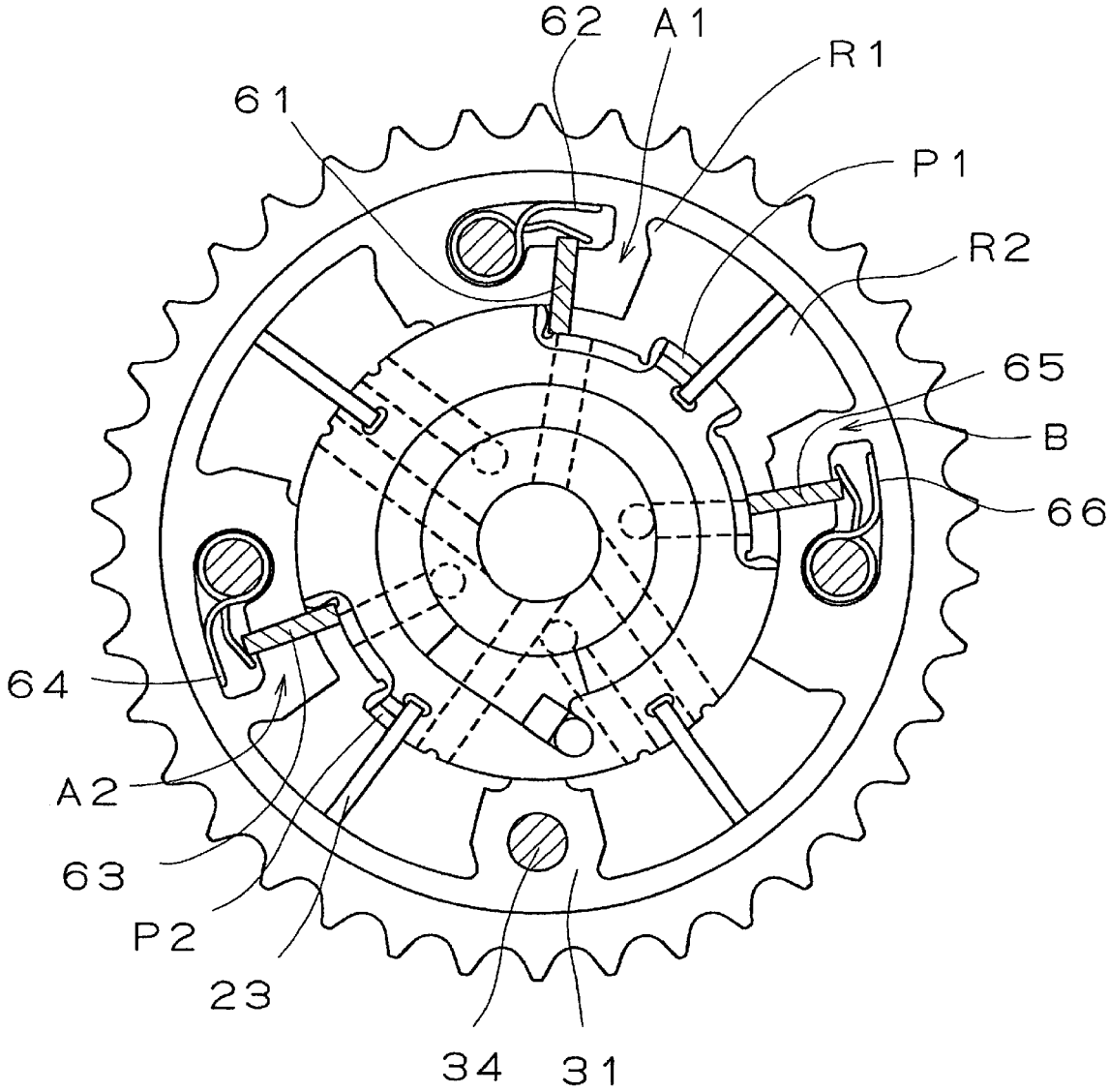
FIG. 4 is a cross-sectional view similar to FIG. 2 illustrating the main rotor rotated to an intermediate lock phase from the set phase relative to the housing body.

The first controlling mechanism A1 is actuated in response to the operation fluid to be supplied to and discharged from the advanced angle passage 11. The first controlling mechanism A1 allows the relative rotation of the housing member 30 and the rotor member 20 under the unlock condition, and restricts the rotation of the rotor member 20 to the advanced angle side relative to the housing member 30 at the intermediate lock phase (the intermediate advanced angle in the graph of FIG. 5) between the most advanced angel phase and the most retarded angle phase under the lock condition (as shown in FIG. 4). The first controlling mechanism A1 includes a lock plate 61 and a lock spring 62.

The lock plate 61 is slidably movable in the radial direction within a radial retracting groove 31*e* formed in the housing body 31. The lock plate 61 is biased to be projected from the retracting groove 31*e* by the lock spring 62 accommodated in a receiving portion 31*f* of the housing body 31. The receiving portion 31*f* of the housing body 31 is atmospherically open through an open bore provided at the rear thin plate 33. Accordingly, smooth movement of the lock plate 61 in the radial direction is assured. The lock plate 61 (and the other lock plates being described hereinafter) is indicated with hatching in the drawing figure for easy understanding.

The end portion (radial inner end) of the lock plate 61 is slidably and detachably supported (i.e., can be disposed in and detached from) in a lock groove 21*i* formed in the main rotor 21. Through the supply of operation fluid to the lock groove 21*i*, the lock plate 61 is moved in the radial direction and is received in the retracting groove 31*e* by overcoming the biasing force (predetermined as a small value) of the lock spring 62. The end portion of the lock plate 61 can contact the bottom surface of the lock groove 21*i* or the outer periphery of the main rotor 21, and is slidably movable in the peripheral direction under the contacting condition.

When the rotor member 20 is positioned at the intermediate lock phase relative to the housing member 30 as shown in FIG. 4, the end portion on the advanced angle side of the lock groove 21*i* is opposed to the retracting groove 31*e*. The axial end portion of the lock groove 21*i* is formed with a recess portion 21*j* where the operation fluid can be stored. The lock groove 21*i* is in communication with the advanced angle passage 11 through the radial passage 21*d* and is in communication with the advanced angle chamber R1 through the passage P1 extending in the peripheral direction.

The second controlling mechanism A2 is actuated in response to the operation fluid to be supplied to and discharged from the retarded angle passage 12. The second controlling mechanism A2 allows the relative rotation of the housing member 30 and the rotor member 20 under the unlock condition, and restricts the rotation of the rotor member 20 to the retarded angle side relative to the housing member 30 at the intermediate lock phase (intermediate advanced angle in the graph of FIG. 5) under the lock condition as shown in FIG. 4. The second controlling mechanism A2 includes a lock plate 63 and a lock spring 64.

The lock plate 63 is slidably movable in the radial direction within a radial retracting groove 3*g* formed in the housing body 31. The lock plate 63 is biased to be projected from the retracting groove 31*g* by the lock spring 64 that is accommodated in a receiving portion 31*h* of the housing body 31. The receiving portion 31*h* of the housing body 31 is atmospherically open through an open bore provided at the rear thin plate 33. Accordingly, smooth movement of the lock plate 63 in the radial direction is assured.

The end portion (radial inner end) of the lock plate 63 is slidably and detachably supported (i.e., can be disposed in and detached from) in a lock groove 21*m* formed in the main rotor 21. Through the supply of operation fluid to the lock groove 21*m*, the lock plate 63 is moved in the radial direction and received in the retracting groove 31*g* by overcoming the biasing force (predetermined as a small value) of the lock spring 64. The end portion of the lock plate 63 can contact the bottom surface of the lock groove 21*m* or the outer periphery of the main rotor 21, and is slidably movable in the peripheral direction under the contacting condition.

When the rotor member 20 is positioned at the intermediate lock phase relative to the housing member 30 as shown in FIG. 4, the end portion on the retarded angle side of the lock groove 21*m* is opposed to the retracting groove 31*g*. The axial end portion of the lock groove 21*m* is formed with a recess portion 21*n* where the operation fluid can be stored. The lock groove 21*m* is in communication with the retarded angle passage 12 through the radial passage 21*g* and the axially extending passage 21*e* , and is in communication with the retarded angle chamber R2 directly or through the passage P2 extending in peripheral direction.

Figure 3:
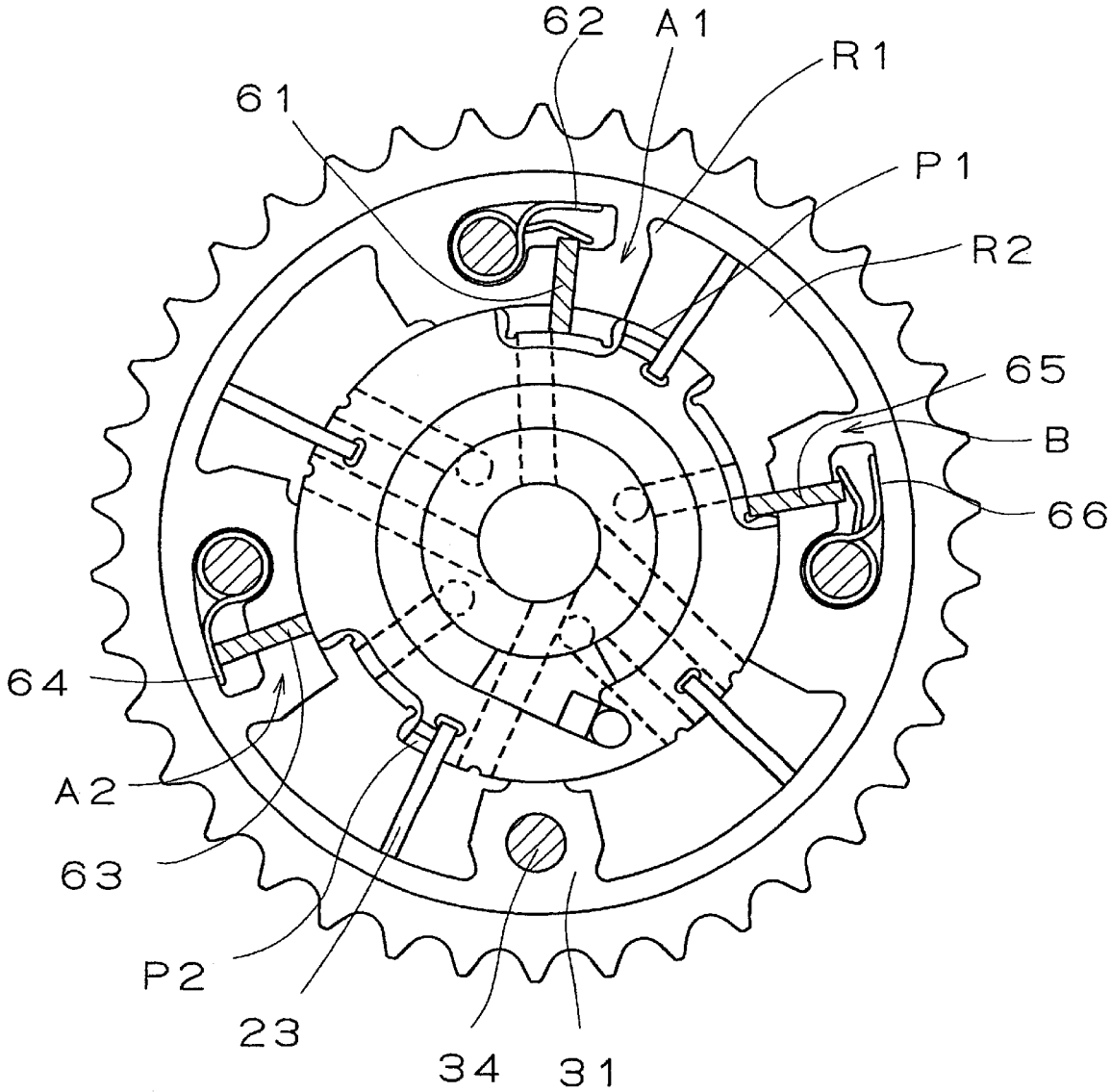
FIG. 3 is a cross-sectional view similar to FIG. 2 illustrating the main rotor rotated to a set phase from a most retarded angle phase relative to the housing body.

The auxiliary controlling mechanism B is actuated in response to the operation fluid to be supplied to and discharged from the retarded angle passage 12. The auxiliary controlling mechanism B allows relative rotation of the housing member 30 and the rotor member 20 under the unlock condition, and restricts the rotation of the rotor member 20 only to the retarded angle side relative to the housing member 30 at the set phase (a quarter advanced angle in the graph of FIG. 5) between the most retarded angel phase and the intermediate lock phase under the lock condition as shown in FIG. 3. The auxiliary controlling mechanism B includes a lock plate 65 and a lock spring 66.

The lock plate 65 is slidably movable in the radial direction within a radial retracting groove 31*i* formed in the housing body 31. The lock plate 65 is biased to be projected from the retracting groove 31*i* by the lock spring 66 accommodated in a receiving portion 31*j* of the housing body 31. The receiving portion 31*j* of the housing body 31 is atmospherically open through an open bore provided at the rear thin plate 33. Accordingly, smooth movement of the lock plate 65 in the radial direction is assured.

The end portion (radial inner end) of the lock plate 65 is slidably and detachably supported (i.e., can be disposed in and detached from) in a lock groove 21*r* formed in the main rotor 21. By the supply of the operation fluid to the lock groove 21*r*, the lock plate 65 is moved in the radial direction and is received in the retracting groove 31*i* by overcoming the biasing force (predetermined as a small value) of the lock spring 66. The end portion of the lock plate 65 can contact the bottom surface of the lock groove 21*r* or the outer periphery of the main rotor 21, and is slidably movable in the peripheral direction under the contacting condition.

When the rotor member 20 is positioned at the set phase relative to the housing member 30 as shown in FIG. 3, the end portion on the retarded angle side of the lock groove 21*r* is opposed to the retracting groove 31*i*. The axial end portion of the lock groove 21*r* is formed with a recess portion 21*s* where the operation fluid can be stored. The lock groove 21*r* is in communication with the retarded angle passage 12 through the radial direction passage 21*h* and the axial direction passage 21*e* , and is directly in communication with the retarded angle chamber R2.

The torsion spring S disposed between the housing member 30 and the rotor member 20 rotatably biases the rotor member 20 to the advanced angle side relative to the housing member 30. The biasing force of the torsion spring S is predetermined to be of amount for canceling a force derived from a spring (not shown) biasing the intake valve towards the closing position, which eventually biases the camshaft 10 and the rotor member 20 towards the retarded angle side. Thus, good responsiveness can be obtained when the relative rotation phase of the rotor member 20 to the housing member 30 is varied to the advanced angle side.

The fluid pressure controlling valve 100 as shown in FIG. 1 comprises a part of the fluid pressure circuit C together with an oil pump 110 and an oil reservoir 120 of the internal combustion engine. A spool 104 can be moved left from the position in FIG. 1 against the force of a spring 105 through energization of a solenoid 103 in response to an output signal from an energization controlling device 200. By varying the duty value (%), the operation fluid can be controlled to be supplied to or discharged from the advanced angle passage 11, the retarded angle passage 12, the first controlling mechanism A1 , the second controlling mechanism A2, and the auxiliary controlling mechanism B.

The oil pump 110 is actuated by the internal combustion engine, by which the operation fluid is supplied to a supply port 106 of the fluid pressure controlling valve 100 from the oil reservoir 120 of the internal combustion engine. The oil reservoir 120 of the internal combustion engine is connected with a discharge port 107 of the fluid pressure controlling valve 100. The operation fluid is thus returned from the discharge port 107. The energization controlling device 200 controls the output (duty value) based on detected signals from various sensors (e.g., sensors for detecting the crank angle, the cam angle, the throttle opening degree, the engine rpm, the temperature of the engine cooling water, and the vehicle speed) in response to the operation condition of the internal combustion engine by following a predetermined controlling pattern.

According to this described and illustrated embodiment of the variable valve timing system of the present invention, when the internal combustion engine is not operated, the operation fluid is returned to the oil reservoir 120 of the internal combustion engine from each advanced angle chamber R1, each retarded angle chamber R2, the lock groove 21*i* of the first controlling mechanism A1 , the lock groove 21*m* of the second controlling mechanism A2, and the lock groove 21*r* of the auxiliary controlling mechanism B through gaps formed among the members. At an early stage of the internal combustion engine starting, the operation fluid is not sufficiently discharged even though the oil pump 110 is actuated by the internal combustion engine. Further, the operation fluid is not sufficiently supplied to each advanced angle chamber R1, each retarded angle chamber R2, the lock groove 21*i* of the first controlling mechanism A1 , the lock groove 21*m* of the second controlling mechanism A2, and the lock groove 21*r* of the auxiliary controlling mechanism B from the fluid pressure circuit C, even though the energization to the solenoid 103 of the fluid pressure controlling valve 100 is controlled by the energization controlling device 200.

Accordingly, when the internal combustion engine is started, the relative rotation phase of the rotor member 20 to the housing member 30 cannot be maintained by the pressure of the operation fluid. When the relative rotation phase of the rotor member 20 to the housing member 30 is not positioned at the intermediate lock phase but at the most retarded angle phase as shown in FIG. 2, the housing member 30 and the rotor member 20 are relatively rotated by the torque fluctuation affecting the camshaft 10 and the biasing force of the torsion spring S as shown in FIG. 5.

The auxiliary controlling mechanism B restricts the rotation of the rotor member 20 only to the retarded angle side relative to the housing member 30 at the set phase between the most retarded angle phase and the lock phase under the lock condition. Accordingly, when the relative rotation phase of the housing member 30 and the rotor member 20 is varied from the most retarded angle phase to the set phase (tal in FIG. 5) by the torque fluctuation affecting the camshaft 10 and the biasing force of the torsion spring S, the auxiliary controlling mechanism B comes into the lock condition (i.e., the lock plate 65 is disposed into the lock groove 21*r* by the force of the lock spring 66). Then the auxiliary controlling mechanism B restricts the rotation of the rotor member 20 only to the retarded angle side relative to the housing member 30 as shown in FIG. 3, and the initial value of the relative rotation phase is held at the set phase (the quarter advanced phase in FIG. 5).

Figure 5:
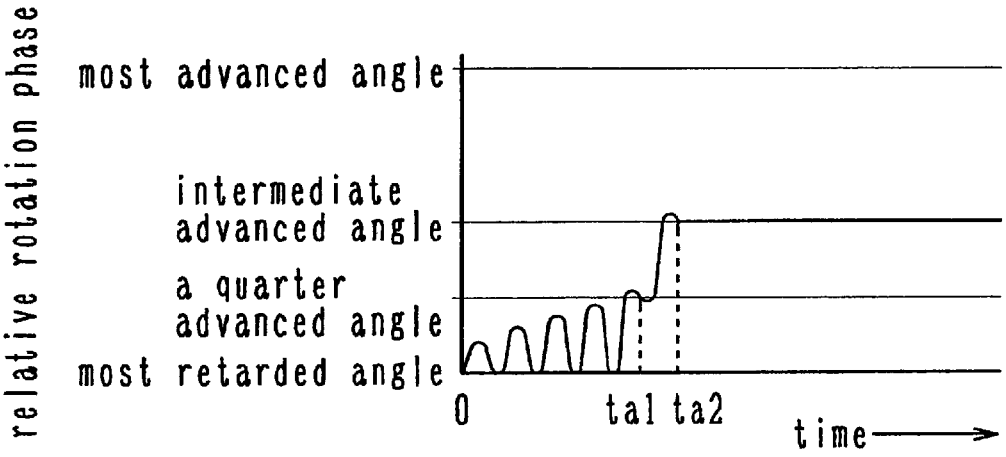
FIG. 5 is a diagram indicating a relative rotation phase of the main rotor and the housing body when the relative rotation is varied from FIG. 2 to FIG. 4 via FIG. 3 at the starting of the internal combustion engine.
Figure 6:
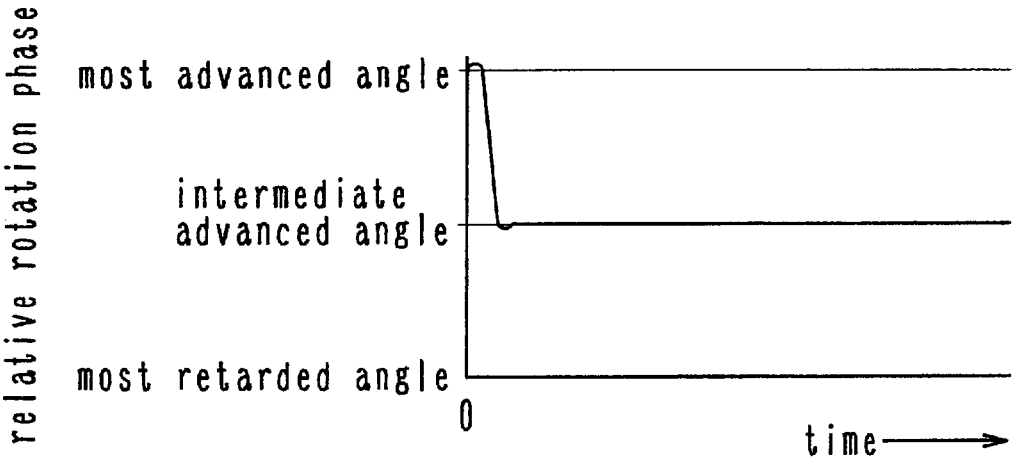
FIG. 6 is a diagram indicating the relative rotation phase of the main rotor and the housing body when the relative rotation is varied from the most advanced angle phase to FIG. 4 at the starting of the internal combustion engine.
Figure 7:
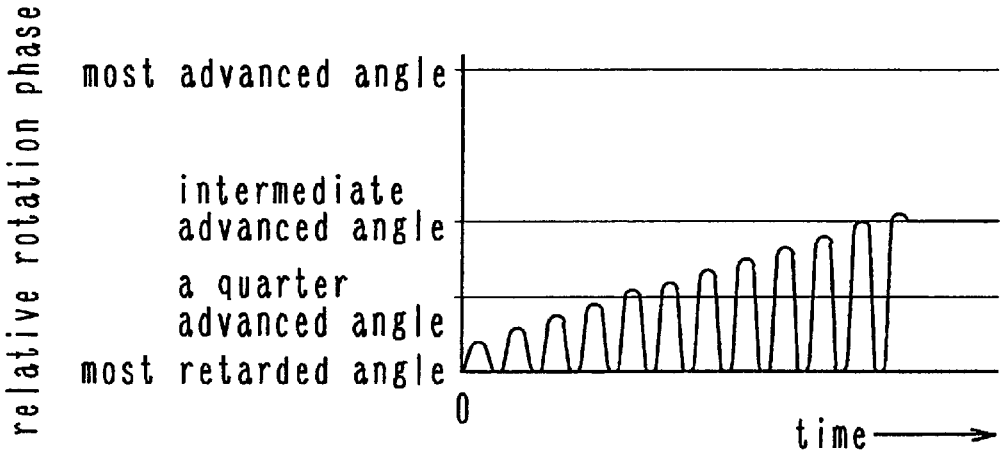
FIG. 7 is a diagram indicating the relative rotation phase of the main rotor and the housing body when the relative rotation is varied from FIG. 2 to FIG. 4 via FIG. 3 without an auxiliary controlling mechanism at the starting of the internal combustion engine.

Thus as shown in FIG. 5, the relative rotation phase of the housing member 30 and the rotor member 20 is instantly varied to the lock phase afterwards by the torque fluctuation affecting the camshaft 10 and the biasing force of the torsion spring S. Then the relative rotation phase of the housing member 30 and the rotor member 20 is restricted by both the controlling mechanisms A1 , A2 as shown in FIG. 4. Accordingly, the time required for the relative rotation of the housing member 30 and the rotor member 20 to be restricted at the lock phase (point ta2 in FIG. 5) from the point of the internal combustion engine starting (0 point in FIG. 5) by both the controlling mechanisms A1 , A2 can be reduced compared to the case without the auxiliary controlling mechanism B (refer to FIG. 7). In addition, the occurrence of a hitting sound by the vane 23 touching or contacting the projection 31*c* can be reduced. A1 so, defects associated with the starting ability of the internal combustion engine can be decreased. When the relative rotation phase of the housing member 30 and the rotor member 20 is positioned at the most advanced angle phase at the starting of the internal combustion engine, the housing member 30 and the rotor member 20 are relatively rotated as shown in FIG. 6 by the torque fluctuation affecting the camshaft 10 and the biasing force of the torsion spring S. Then, as shown in FIG. 4, the relative rotation of the housing member 30 and the rotor member 20 is restricted at the lock phase by both the controlling mechanisms A1 , A2 immediately after the internal combustion engine is started.

Under the condition shown in FIG. 4, the rotation of the rotor member 20 to the advanced angle side relative to the housing member 30 is restricted while the lock plate 61 of the first controlling mechanism A1 is disposed in the lock groove 21*i* by the biasing force of the lock spring 62. At the same time, the rotation of the rotor member 20 to the retarded angle side relative to the housing member 30 is restricted while the lock plate 63 of the second controlling mechanism A2 is disposed in the lock groove 21*m* by the biasing force of the lock spring 64. Thus the relative rotation of the housing member 30 and the rotor member 20 is restricted and maintained at the intermediate lock phase by the first controlling mechanism A1 and the second controlling mechanism A2. Thus, the occurrence of a hitting sound associated with the vane 23 touching or contacting the projection 31*c* of the housing body 31 can be prevented, and the starting ability of the internal combustion engine can be improved by obtaining the appropriate valve timing for the starting.

Meanwhile, when the internal combustion engine is under the normal operation condition (i.e., the condition excluding the starting of the operation), the oil pump 110 is actuated by the internal combustion engine and the operation fluid is sufficiently discharged. Then the operation fluid is sufficiently supplied to each advanced angle chamber R1, each retarded angle chamber R2, the lock groove 21*i* of the first controlling mechanism A1 , the lock groove 21*m* of the second controlling mechanism A2, and the lock groove 21*r* of the auxiliary controlling mechanism B from the fluid pressure circuit C. Thus the relative rotation phase of the rotor member 20 with respect to the housing member 30 can be adjusted and maintained at a desired phase within the range from the most retarded angle phase (the phase in which the volume of the advanced angle chamber R1 is a minimum and the volume of the retarded angle chamber R2 is a maximum) to the most advanced angle phase (the phase in which the volume of the advanced angle chamber R1 is a maximum and the volume of the retarded angle chamber R2 is a minimum) by the energization of the solenoid 103 of the fluid pressure controlling valve 100 being controlled by the energization controlling device 200. Under the normal operation condition of the internal combustion engine, the variable valve timing of the intake valve can be appropriately adjusted between the operation at the most retarded angle phase and the operation at the most advanced angle phase by the fluid pressure supplied to the advanced angle chamber and the retarded angle chamber.

In this case, the relative rotation phase of the rotor member 20 to the advanced angle side relative to the housing member 30 is adjusted by the supply of the operation fluid to each advanced angle chamber R1 and the lock groove 21*i* of the first controlling mechanism A1 through the fluid pressure controlling valve 100, and by the discharge of the operation fluid from each retarded angle chamber R2, the lock groove 21*m* of the second controlling mechanism A2, and the lock groove 21*m* of the auxiliary controlling mechanism through the fluid pressure controlling valve 100.

At this time, under the following condition, the rotor member 20 is rotated to the advanced angle side relative to the housing member 30 while the operation fluid is supplied to each advanced angle chamber R1 and the lock groove 21*i*, and is discharged from each retarded angle chamber R2 and the lock grooves 21*m*, 21*r*. The condition is that once the operation fluid is supplied to the lock groove 21*i* of the first controlling mechanism A1 , the lock plate 61 is actuated against the force of the lock spring 62 and received in the retracting groove 31*e* or slidably in contact with the outer periphery of the main rotor 21. Besides, the lock plates 63, 65 are slidably in contact with the bottom surface of the respective lock grooves 21*m*,21*r* as shown in FIG. 4.

The relative rotation phase of the rotor member 20 to the retarded angle side relative to the housing 30 is adjusted by the supply of the operation fluid to each retarded angle chamber R2, the lock groove 21*m* of the second controlling mechanism A2, and the lock groove 21*r* of the auxiliary controlling mechanism B through the fluid pressure controlling valve 100 and by the discharge of the operation fluid from each advanced angle chamber R1 and the lock groove 21*i* of the first controlling mechanism A1 through the fluid pressure controlling valve 100.

At this time, under the following condition, the rotor member 20 is rotated to the retarded angle side relative to the housing member 30 because the operation fluid is supplied to each retarded angle chamber R2, the lock groove 21*m* of the second controlling mechanism A2, and the lock groove 21*r* of the auxiliary controlling mechanism B and is discharged from each advanced angle chamber R1 and the lock groove 21*i* of the first controlling mechanism A1 . The condition is that once the operation fluid is supplied to the lock groove 21*m* of the second controlling mechanism A2 and to the lock groove 21*r* of the auxiliary controlling mechanism B, the lock plate 63 is actuated against the force of the lock spring 64 and is received in the retracting groove 31*g*, and further the lock plate 65 is actuated against the force of the lock spring 66 and received in the retracting groove 31*i*, or the lock plates 63, 65 are slidably in contact with the outer periphery of the main rotor 21. In addition, the lock plate 61 is slidably in contact with the bottom surface of the lock groove 21*i*.

Figure 8:
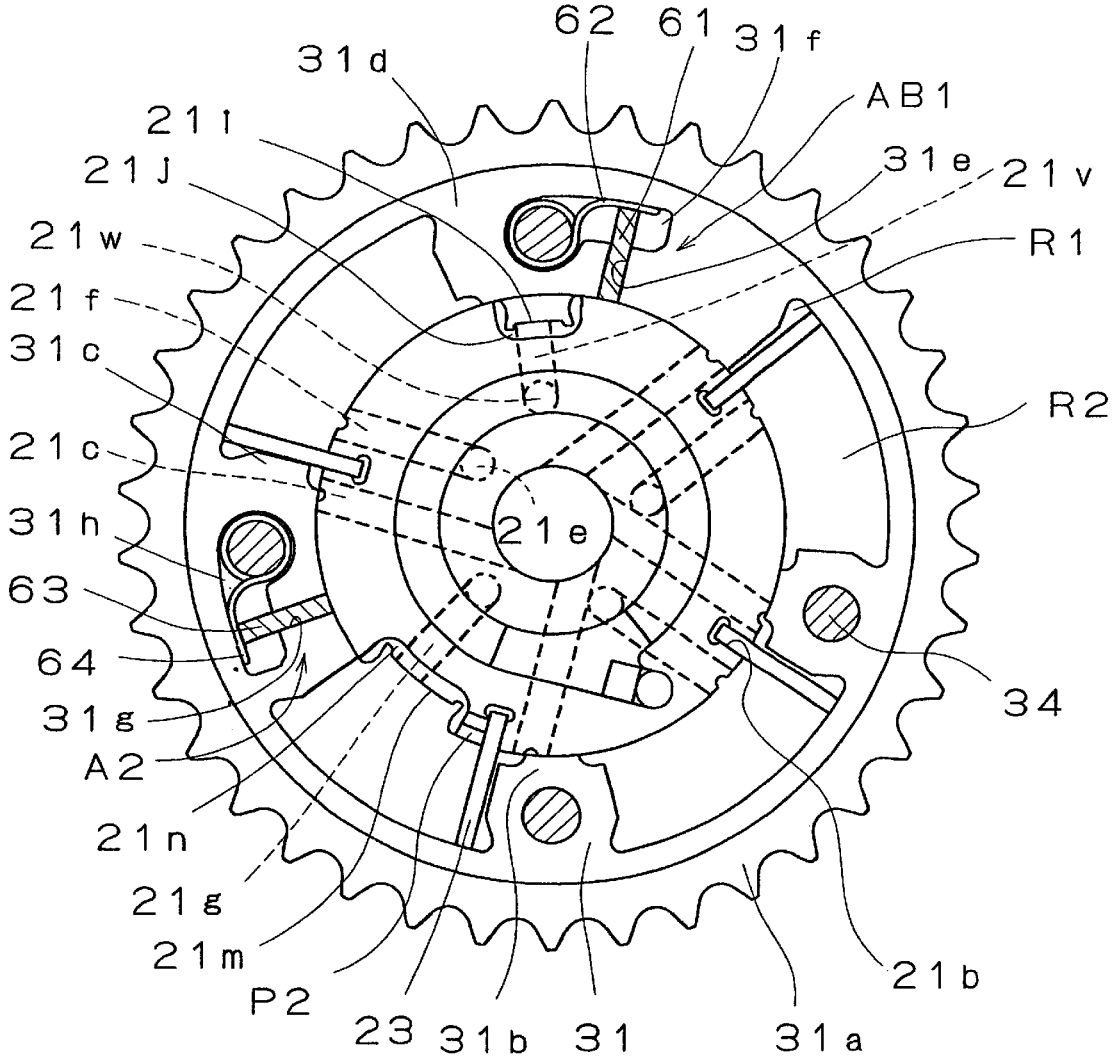
FIG. 8 is a cross-sectional view of a portion of a variable valve timing system according to a second embodiment.

In the first embodiment of the present invention described above, the first controlling mechanism A1 and the auxiliary controlling mechanism B are separately configured. However, in accordance with a second embodiment shown in FIGS. 8–10, it is possible to employ a controlling mechanism A1 which integrally obtains the functions of both the first controlling mechanism A1 and the auxiliary controlling mechanism B. The configuration of the second embodiment of the present invention is the same as that of the first embodiment described above except for the controlling mechanism A1 and so a detailed explanation of those portions will not be repeated. A1 so, because the operation associated with the second embodiment of the present invention is the same as that of the first embodiment described above, a detailed explanation will not be repeated.

The controlling mechanism AB1 of the second embodiment is actuated in response to the supply and discharge of the operation fluid. The controlling mechanism AB1 allows the relative rotation of the housing member 30 and the rotor member 20 under the unlock condition, and restricts the rotation of the rotor member 20 to the retarded angle side relative to the housing member 30 at the set phase (the quarter advanced angle in the graph of FIG. 5) under the lock condition in FIG. 9 and to the advanced angle side relative to the housing member 30 at the intermediate lock phase (the intermediate advanced angle in the graph of FIG. 5) under the lock condition in FIG. 10. The controlling mechanism AB1 is provided with the lock plate 61 and the lock spring 62.

The lock plate 61 is slidably movable in the radial direction within the radial retracting groove 31*e* formed in the housing body 31. The lock plate 61 is biased to be projected from the retracting groove 31*e* by the lock spring 62 accommodated in the receiving portion 31*f* of the housing body 31. The receiving portion 31*f* of the housing body 31 is atmospherically open through an open bore provided at the rear thin plate 33. Accordingly, smooth movement of the lock plate 61 in the radial direction is assured.

The end portion (radial inner end) of the lock plate 61 is slidably and detachably supported (i.e., can be disposed in and detached from) in the lock groove 21*i* formed in the main rotor 21. By the supply of the operation fluid to the lock groove 21*i*, the lock plate 61 is moved in the radial direction and received in the retracting groove 31*e* by overcoming the biasing force (predetermined as a small value) of the lock spring 62. The end portion of the lock plate 61 can contact the bottom surface of the lock groove 21*i* or the outer periphery of the main rotor 21, and is slidably movable in the peripheral direction under the contacting condition.

Figure 9:
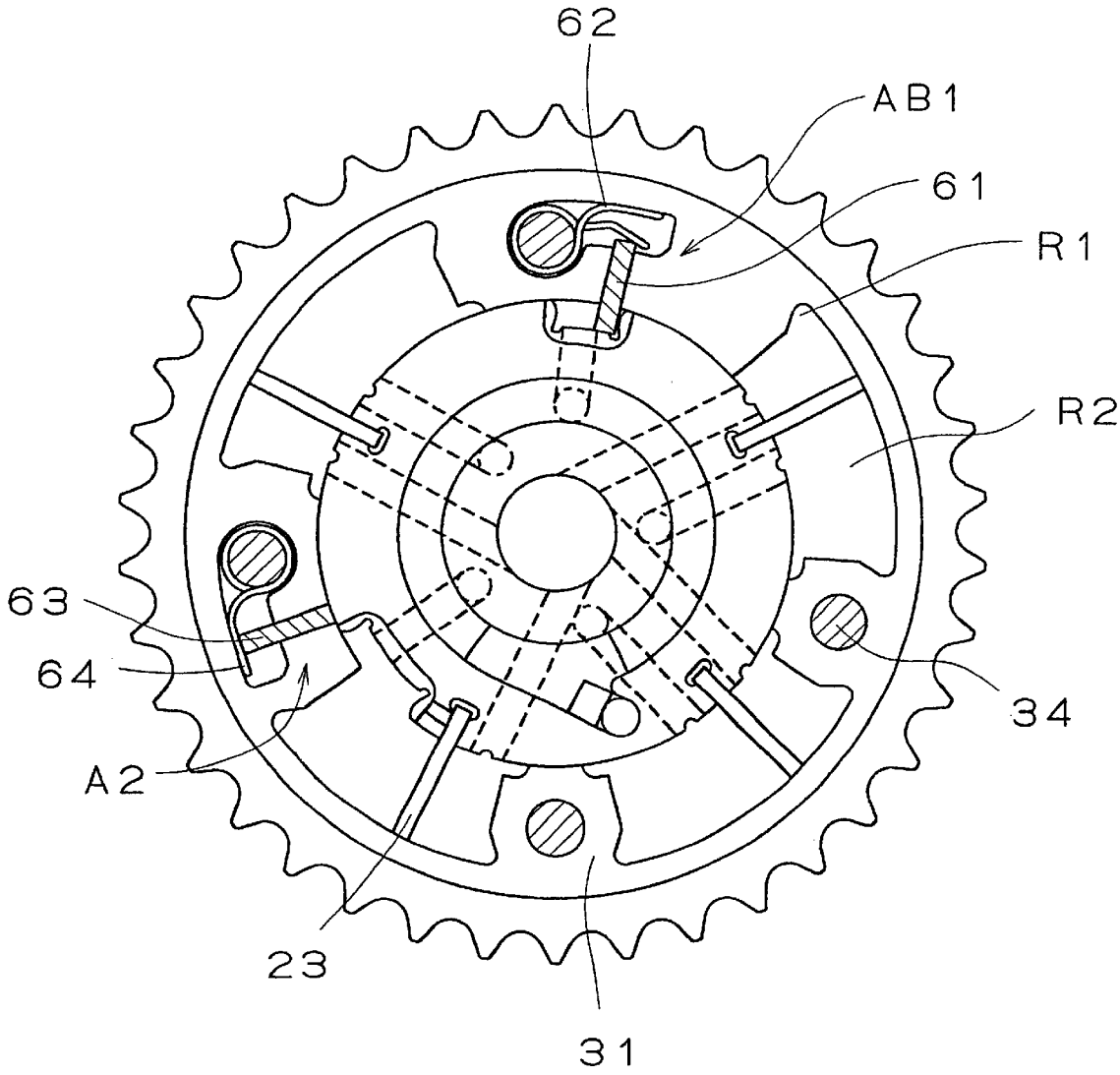
FIG. 9 is a cross-sectional view similar to FIG. 8 illustrating the main rotor rotated to a set phase from a most retarded angle phase relative to the housing body.
Figure 10:
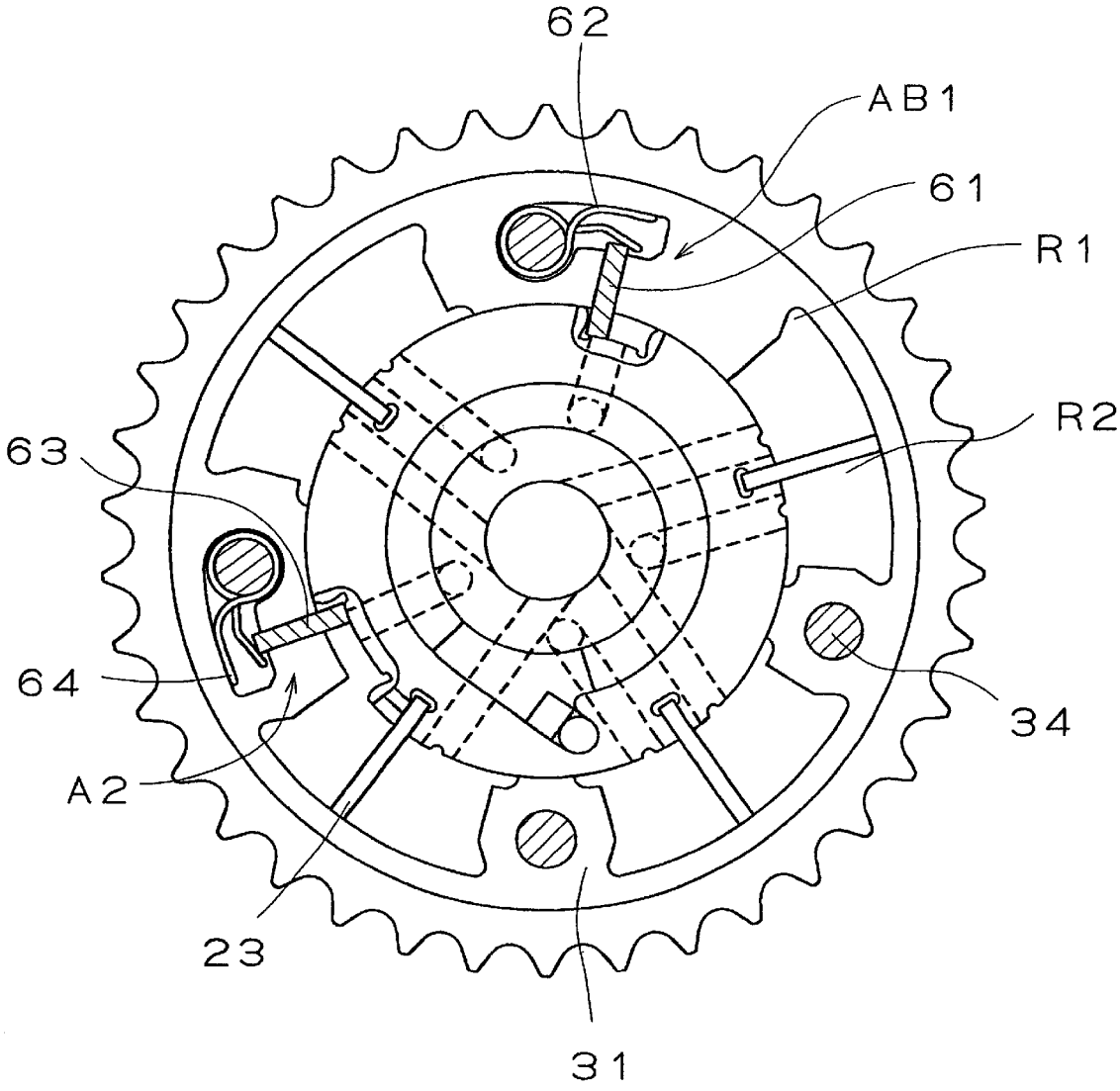
FIG. 10 is a cross-sectional view similar to FIG. 8 illustrating the main rotor rotated to an intermediate lock phase from the set phase relative to the housing body.

When the rotor member 20 is positioned at the set phase relative to the housing member 30 as shown in FIG. 9, the end portion on the retarded angle side of the lock groove 21*i* is opposed to the retracting groove 31*e*. When the rotor member 20 is positioned at the intermediate lock phase relative to the housing member 30 as shown in FIG. 10, the end portion on the advanced angle side of the lock groove 21*i* is opposed to the retracting groove 31*e*. The axial end portion of the lock groove 21*i* is formed with the recess portion 21*j* where the operation fluid can be stored. The lock groove 21*i* is in communication with a third passage (not shown) provided in the camshaft through a radial direction passage 21*v* and an axial direction passage 21*w* in axial direction. The operation fluid of the advanced angle passage 11 or the retarded angle passage 12, whichever is higher, is supplied to the third passage.

In the first embodiment described above, the second controlling mechanism A2 and the auxiliary controlling mechanism B are separately configured. However, as a third embodiment of the present invention shown in FIGS. 11–13 or as a fourth embodiment of the present invention shown in FIGS. 14–16, controlling mechanisms AB2*a*, AB2*b* which integrally obtain the functions of both the second controlling mechanism A2 and the auxiliary controlling mechanism B are employed. The configurations and operation of the third embodiment and the fourth embodiment are the same as in the first embodiment described above, except for the controlling mechanisms AB2*a*, AB2*b*, and so a detailed explanation will not be repeated.

Figure 11:
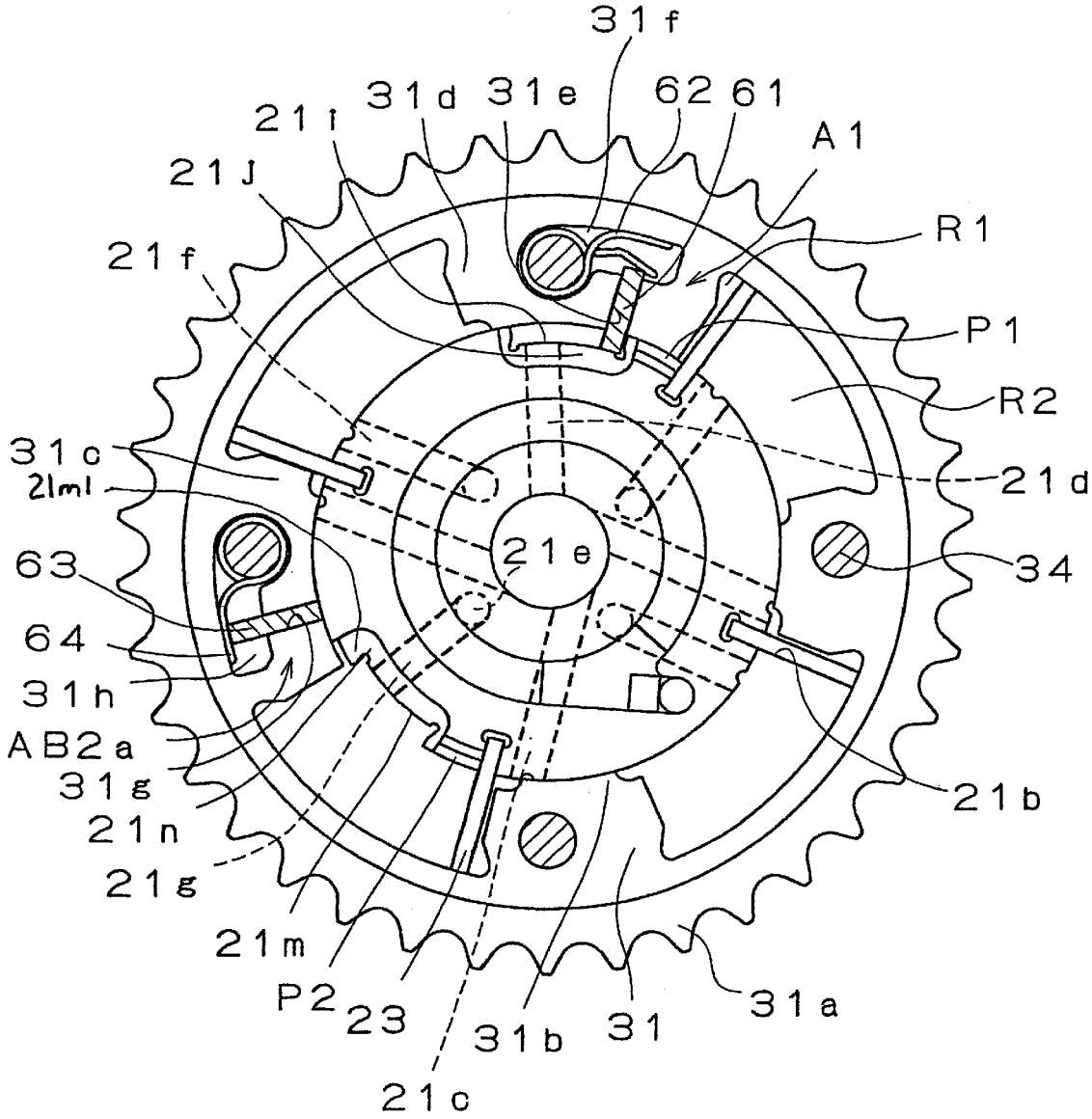
FIG. 11 is a cross-sectional view of a portion of a variable valve timing system according to a third embodiment.
Figure 12:
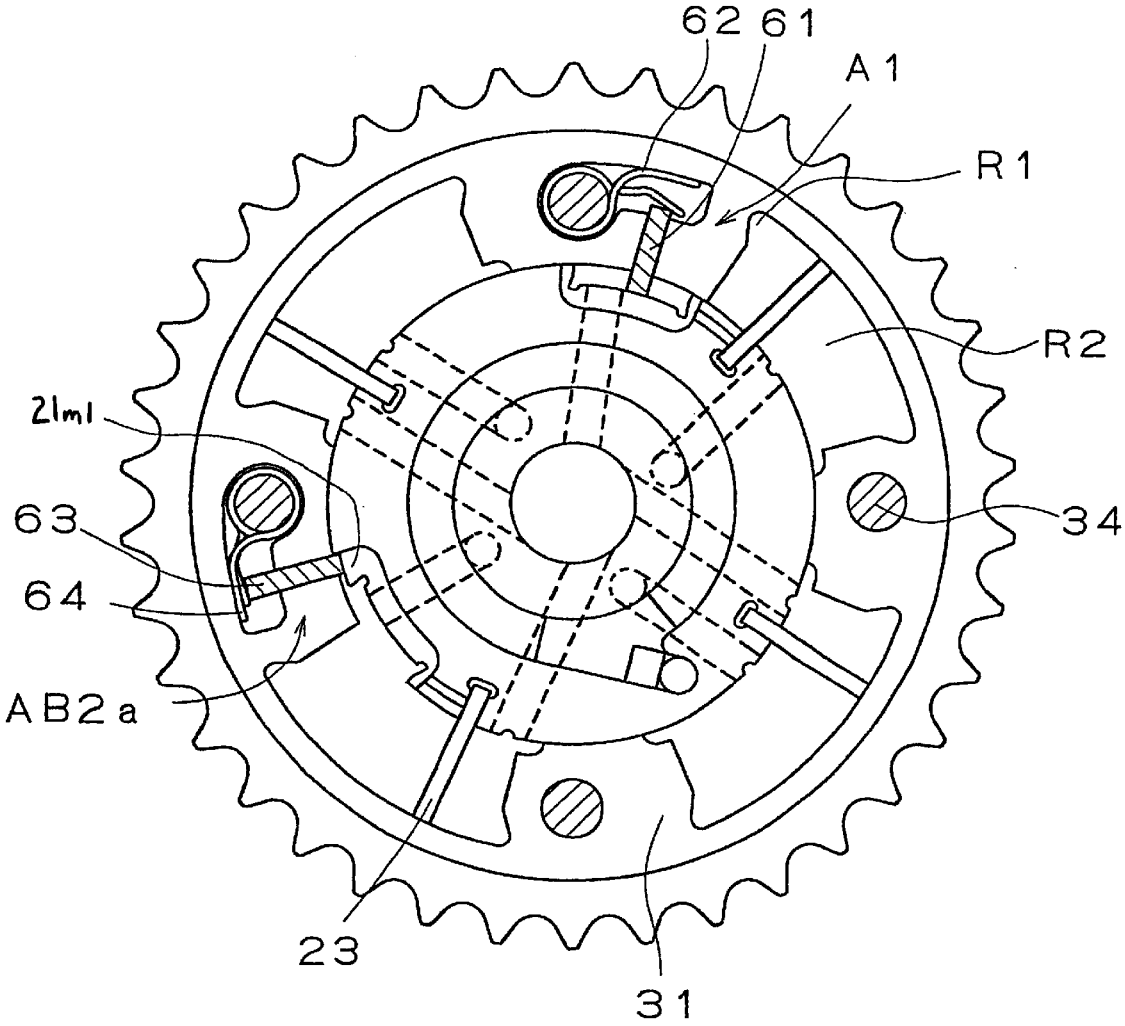
FIG. 12 is a cross-sectional view similar to FIG. 11 illustrating the main rotor rotated to a set phase from a most retarded angle phase relative to the housing body.
Figure 13:
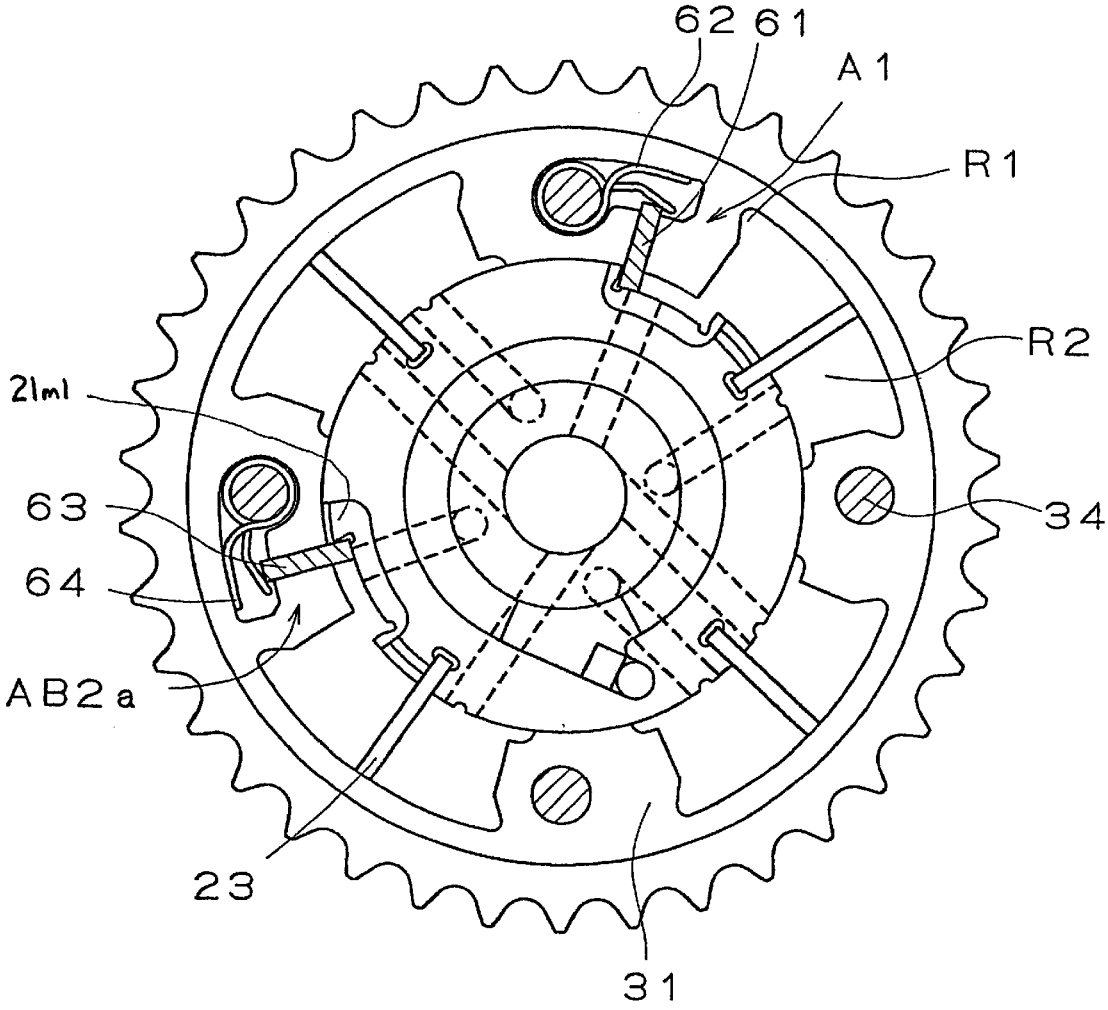
FIG. 13 is a cross-sectional view similar to FIG. 11 illustrating the main rotor rotated to an intermediate lock phase from the set phase relative to the housing body.

The controlling mechanism AB2*a*, of the third embodiment shown in FIGS. 11–13 is actuated in response to the operation fluid to be supplied to and discharged from the retarded angle passage 12. The controlling mechanism AB2*a*, allows the relative rotation of the housing member 30 and the rotor member 20 under the unlock condition, and restricts the rotation of the rotor member 20 to the retarded angle side relative to the housing member 30 at the set phase (a quarter advanced angle in the graph of FIG. 5) under the lock condition in FIG. 12 and also to the retarded angle side relative to the housing member 30 at the intermediate lock phase (the intermediate advanced angle in the graph of FIG. 5) under the lock condition in FIG. 13. The controlling mechanism AB2*a*, is provided with the lock plate 63 and the lock spring 64.

The lock plate 63 is slidably movable in the radial direction within the radial retracting groove 31*g* formed in the housing body 31. The lock plate 63 is biased to be projected from the retracting groove 31*g* by the lock spring 64 accommodated in the receiving portion 31*h* of the housing body 31. The receiving portion 31*h* of the housing body 31 is atmospherically open through an open bore (not shown) provided at the rear thin plate 33. Accordingly, smooth movement of the lock plate 63 in the radial direction is assured.

The end portion (radial inner end) of the lock plate 63 is slidably and detachably supported (i.e., can be disposed in and detached from) in the stepped lock groove 21*m* formed in the main rotor 21. Through the supply of the operation fluid to the lock groove 21*m*,the lock plate 63 is moved in the radial direction and is received in the retracting groove 31*g* by overcoming the biasing force (predetermined as a small value) of the lock spring 64. The end portion of the lock plate 63 can contact the bottom surface of the lock groove 21*m* or the outer periphery of the main rotor 21, and is slidably movable in the peripheral direction under the contacting condition.

The lock groove 21*m* has a step portion 21*ml* next to the end portion on the advanced angle side. The step portion 21*ml* projects from the bottom of the lock groove 21*m* and toward the radial direction of the rotor member 20. The top surface of the step portion is lower than the outer peripheral surface of the rotor member 20 the end surface of the step portion 21*ml* can be attached with the lock plate 63.

When the rotor member 20 is positioned at the set phase relative to the housing member 30 as shown in FIG. 12, the top surface of the step potion 21*ml* is opposed to the retracting groove 31*g*. The lock plate 63 is attached to the end surface of the step portion. Therefore the relative rotation of the rotor member 20 and the housing member 30 to the retarded angle side is thus restricted in the quarter advance phase. When the rotor member 20 is positioned at the intermediate lock phase relative to the housing member 30 as shown in FIG. 13, the bottom of the lock groove 21*m* is opposed to the retracting groove 31*g*. The relative rotation of the rotor member 20 and the housing member 30 to the retarded angle side is thus restricted in the intermediate lock phase. The axial end portion of the lock groove 21*m* is formed with the recess portion 21*n* where the operation fluid can be stored. The lock groove 21*m* is in communication with the retarded angle passage 12 through the radial direction passage 21*g* and the axial direction passage 21*e* , and is in communication with the retarded angle chamber R2 through the passage P2 extending in the peripheral direction.

Figure 14:
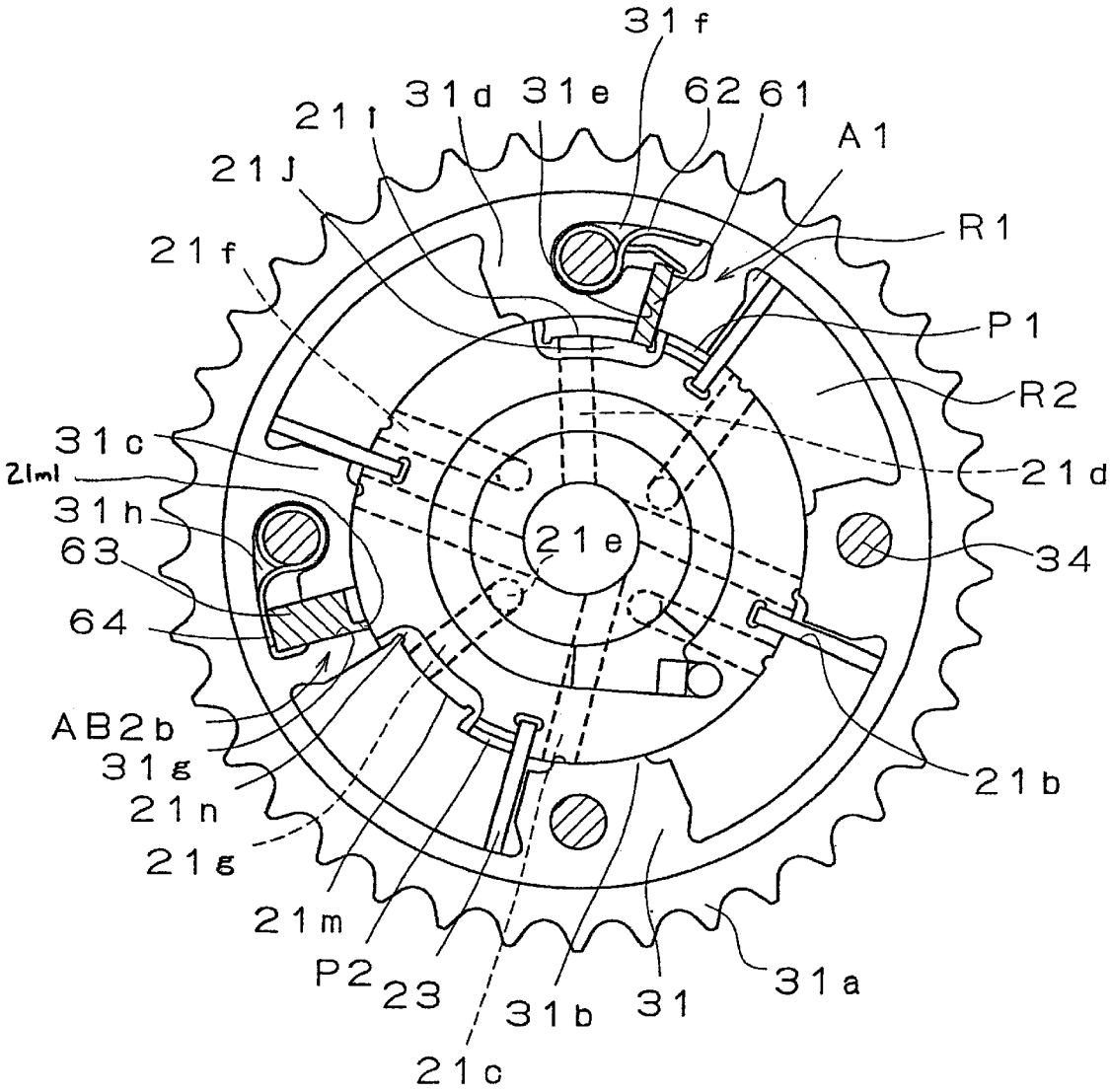
FIG. 14 is a cross-sectional view of a portion of a variable valve timing system according to a fourth embodiment.
Figure 15:
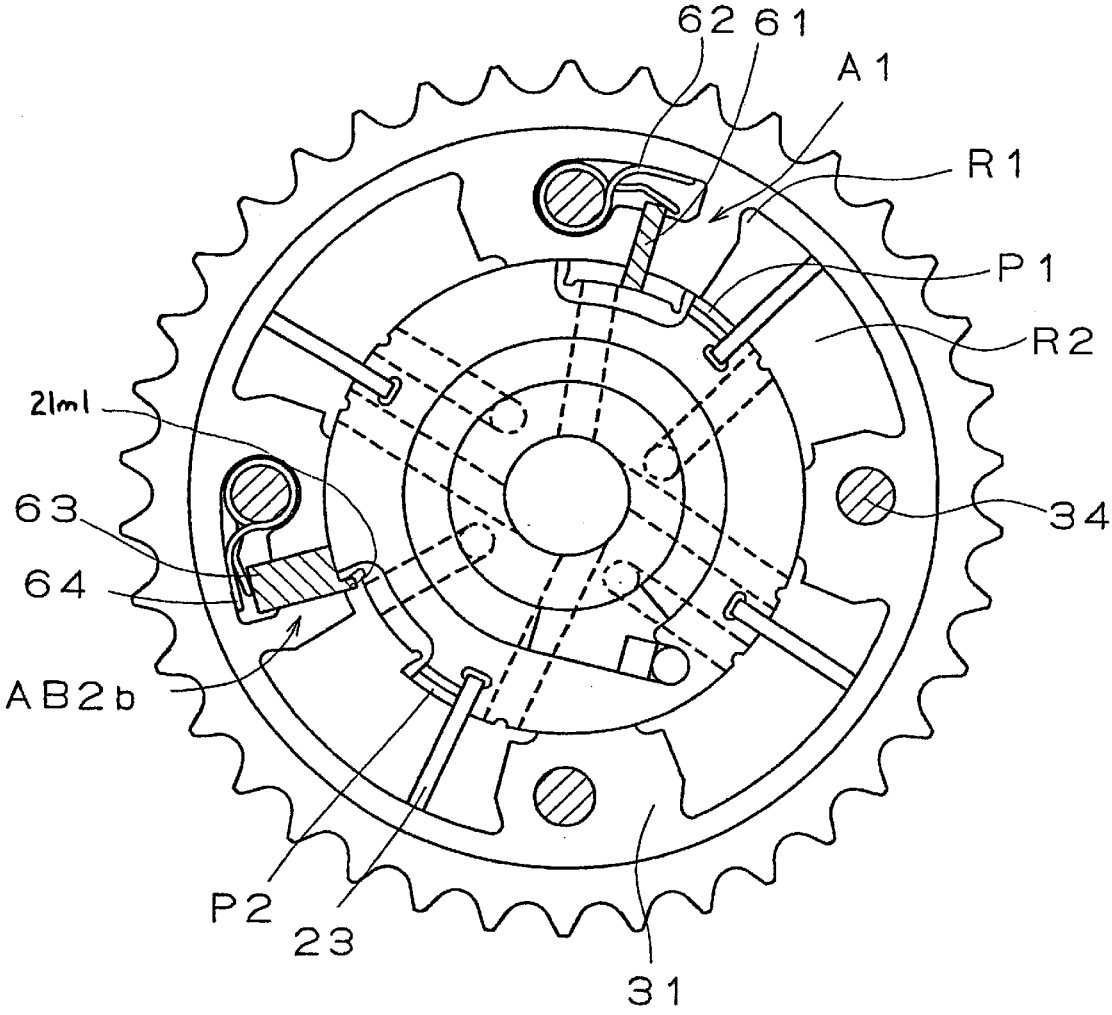
FIG. 15 is a cross-sectional view similar to FIG. 14 illustrating the main rotor rotated to a set phase from a most retarded angle phase relative to the housing body.
Figure 16:
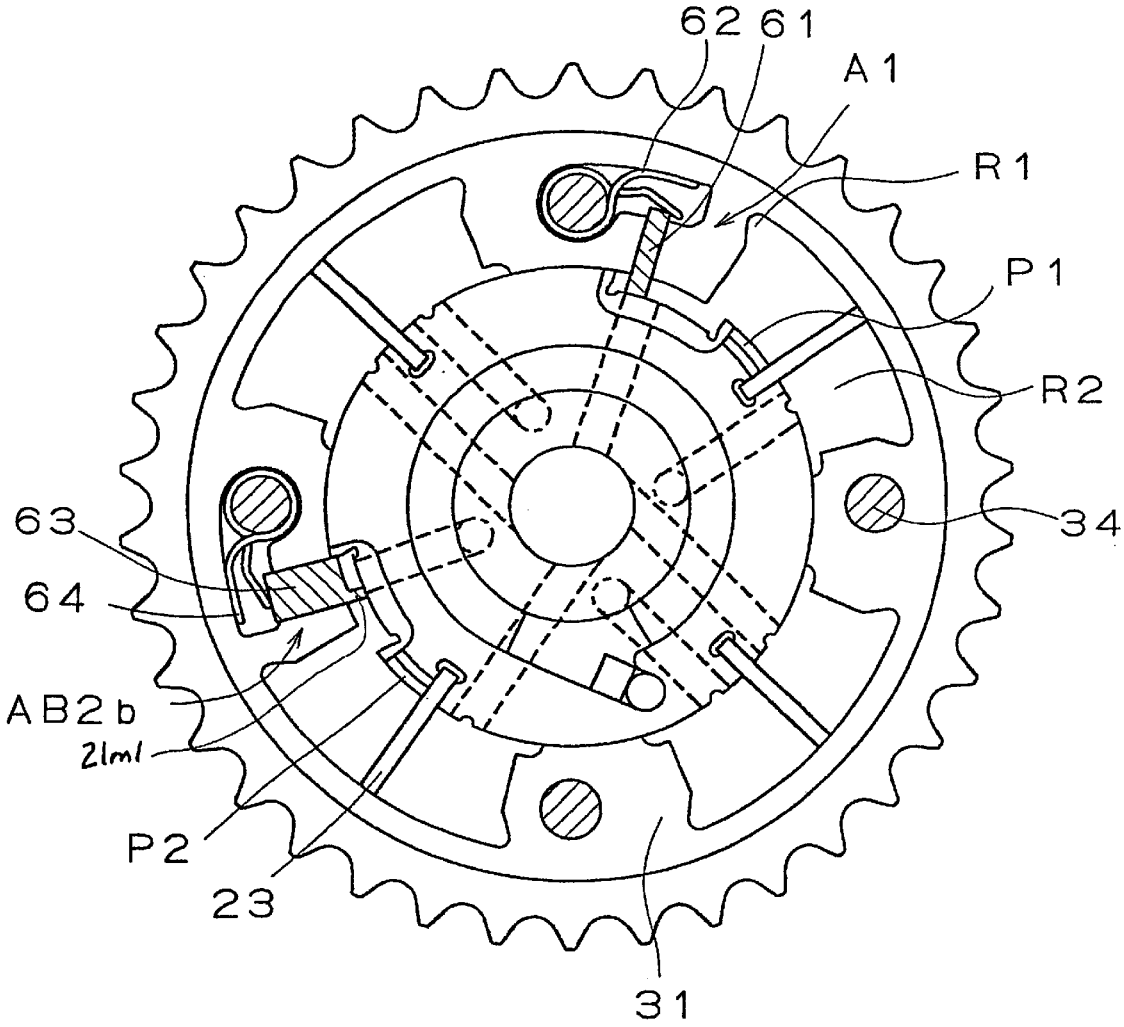
FIG. 16 is a cross-sectional view similar to FIG. 14 illustrating the main rotor rotated to an intermediate lock phase from the set phase relative to the housing body.

The controlling mechanism AB2*b*of the fourth embodiment shown in FIGS. 14–16 is actuated in response to the operation fluid to be supplied to and discharged from the retarded angle passage 12. The controlling mechanism AB2*b* allows relative rotation of the housing member 30 and the rotor member 20 under the unlock condition, and restricts the rotation of the rotor member 20 to the retarded angle side relative to the housing member 30 at the set phase (the quarter advanced angle in the graph of FIG. 5) under the lock condition in FIG. 15 and also to the retarded angle side relative to the housing member 30 at the intermediate lock phase (the intermediate advanced angle in the graph of FIG. 5) under the lock condition in FIG. 16. The controlling mechanism AB2*b*is provided with the lock plate 63 and the lock spring 64.

The lock plate 63 with a stepped radial inner end is slidably movable in the radial direction within the radial retracting groove 31*g* formed in the housing body 31. The lock plate 63 is biased to be projected from the retracting groove 31*g* by the lock spring 64 accommodated in the receiving portion 31*h* of the housing body 31. The receiving portion 31*h* of the housing body 31 is atmospherically open through an open bore (not shown) provided at the rear thin plate 33. Accordingly, smooth movement of the lock plate 63 in the radial direction is assured.

The end portion (radial inner end) of the lock plate 63 is slidably and detachably supported (i.e., can be disposed in and detached from) in the lock groove 21*m* formed in the main rotor 21. Through the supply of the operation fluid to the lock groove 21*m*, the lock plate 63 is moved in the radial direction and received in the retracting groove 31*g* by overcoming the biasing force (predetermined as a small value) of the lock spring 64. The end portion of the lock plate 63 can contact the bottom surface of the lock groove 21*m* or the outer periphery of the main rotor 21, and is slidably movable in the peripheral direction under the contacting condition.

When the rotor member 20 is positioned at the set phase relative to the housing member 30 as shown in FIG. 15, the end portion on the advanced angle side of the lock groove 21*m* is opposed to the stepped portion 63*a* of the lock plate 63. When the rotor member 20 is positioned at the intermediate lock phase relative to the housing member 30 as shown in FIG. 16, the end portion on the advanced angle side of the lock groove 21*m* is opposed to the retracting groove 31*g*. The axial end portion of the lock groove 21*m* is formed with the recess portion 21*n* where the operation fluid can be stored. The lock groove 21*m* is in communication with the retarded angle passage 12 through the radial direction passage 21*g* and the axial direction passage 21*e* , and is in communication with the retarded angle chamber R2 through the passage P2 extending in the peripheral direction.

Figure 17:
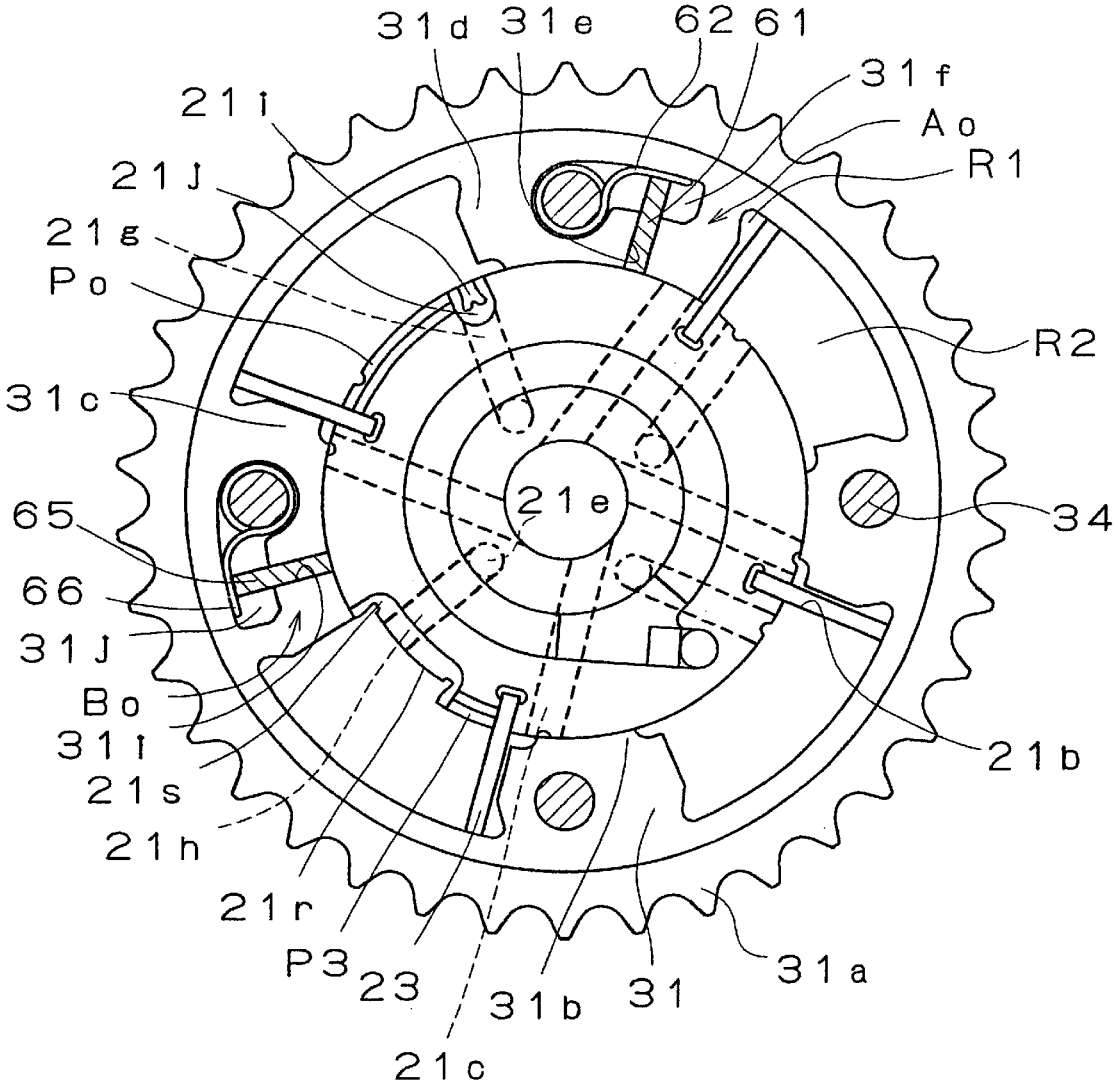
FIG. 17 is a cross-sectional view of a portion of a variable valve timing system according to a fifth embodiment.

According to the first, second, third and fourth embodiments of the present invention described above, the invention is applied to a variable valve timing system equipped on the camshaft for controlling the opening and closing of the intake valve. In addition, the lock phase is designated as the intermediate advanced angle in the graph of FIG. 5 and the set phase is designated as the quarter advanced angle in the graph of FIG. 5. However, according to a fifth embodiment of the present invention shown in FIGS. 17–19, the present invention can also be applied to another variable vale timing system equipped on the camshaft for controlling the opening and closing of the exhaust valve. Here, the lock phase is designated as the most advanced angle in the graph of FIG. 20 at which the relative rotation of the housing member 30 and the rotor member 20 is restricted by a relative rotation controlling mechanism Ao, and the set phase is designated as the intermediate advanced angle in the graph of FIG. 20 at which the rotation of the rotor member 20 only to the retarded angle side relative to the housing member 30 is restricted by an auxiliary controlling mechanism Bo.

Figure 19:
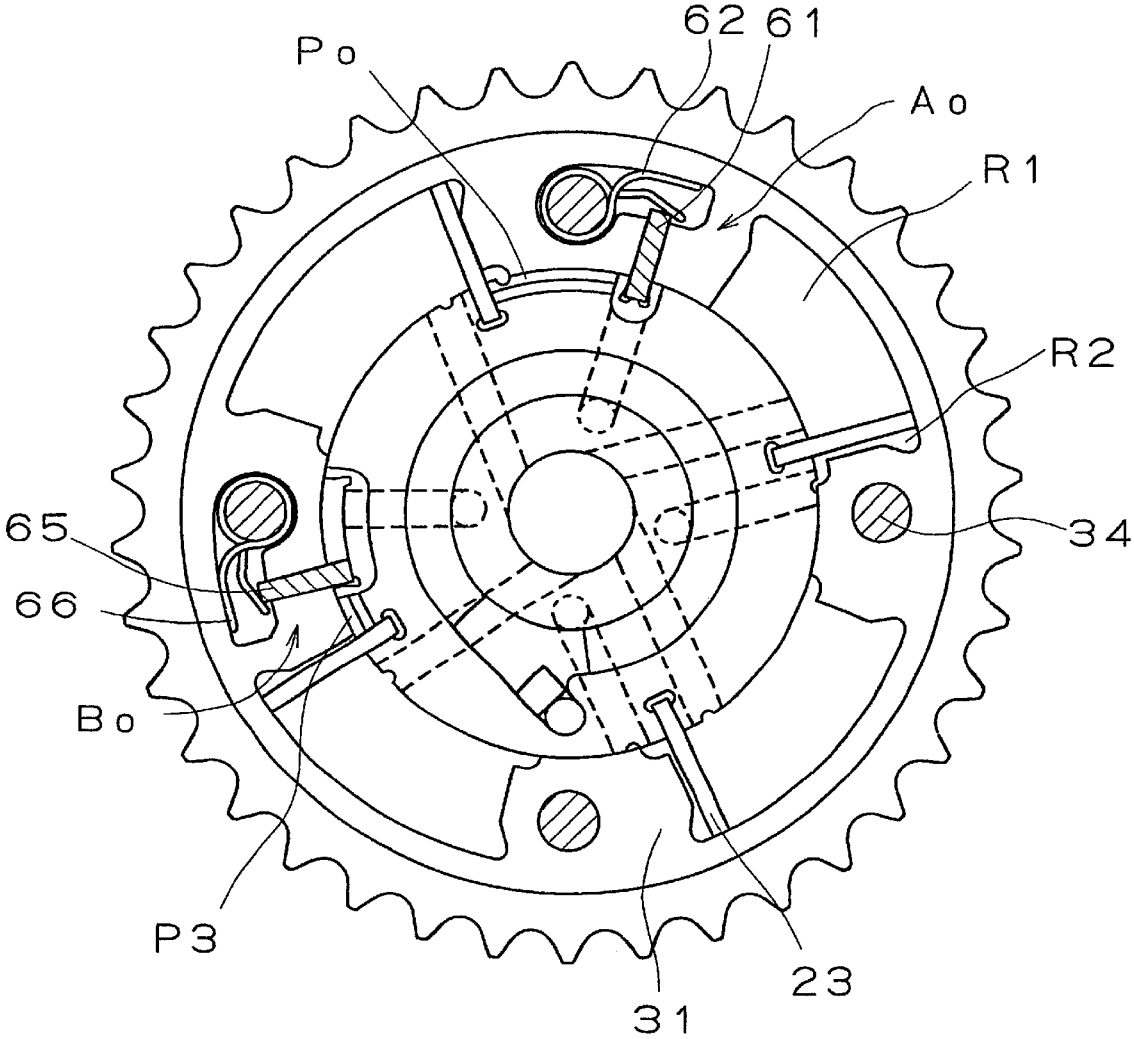
FIG. 19 is a cross-sectional view similar to FIG. 2 illustrating the main rotor rotated to an intermediate lock phase from the set phase relative to the housing body.
Figure 20:
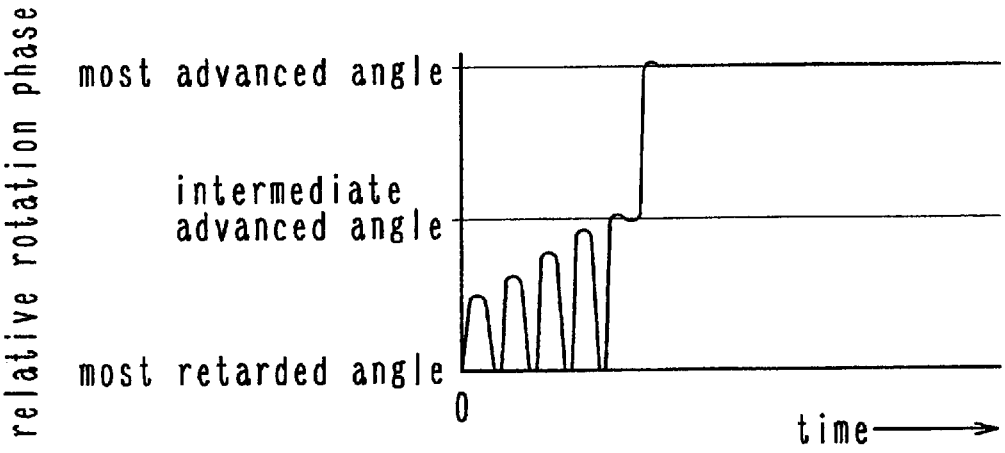
FIG. 20 is a diagram indicating the relative rotation phase of the main rotor and the housing body when the relative rotation is varied from FIG. 17 to FIG. 19 via FIG. 18 at the staring of the internal combustion engine.

The relative rotation controlling mechanism Ao of the fifth embodiment of the present invention is actuated in response to the operation fluid to be supplied to and discharged from the retarded angle passage 12. The relative rotation controlling mechanism Ao allows the relative rotation of t he housing member 30 and the rotor member 20 under the unlock condition, and restricts the relative rotation of the housing member 30 and the rotor member 20 at the lock phase (most advanced angle in the graph of FIG. 20) under the lock condition as shown in FIG. 19. The relative rotation controlling mechanism Ao is provided with the lock plate 61 and the lock spring 62.

The lock plate 61 is slidably movable in the radial direction within the radial retracting groove 31*e* formed in the housing body 31. The lock plate 61 is biased to be projected from the retracting groove 31*e* by the lock spring 62 accommodated in the receiving portion 31*f* of the housing body 31. The receiving portion 31*f* of the housing body 31 is atmospherically open through an open bore (not shown) provided at the rear thin plate 33. Accordingly, smooth movement of the lock plate 61 in the radial direction is assured.

The end portion (radial inner end) of the lock plate 61 is slidably and detachably supported (i.e., can be disposed in and detached from) in the lock groove 21*i* formed in the main rotor 21. Through the supply of operation fluid to the lock groove 21*i*, the lock plate 61 is moved in the radial direction and received in the retracting groove 31*e* by overcoming the biasing force (predetermined as a small value) of the lock spring 62. The end portion of the lock plate 61 can contact the bottom surface of the lock groove 21*i* or the outer periphery of the main rotor 21, and is slidably movable in the peripheral direction under contacting condition. When the rotor member 20 is positioned at the intermediate lock phase relative to the housing member 30 as shown in FIG. 19, the lock groove 21*i* is opposed to the retracting groove 31*e*. The axial end portion of the lock groove 21*i* is formed with the recess portion 21*j* where the operation fluid can be stored. The lock groove 21*i* is in communication with the retarded angle passage 12 through the radial direction passage 21*g* and the axial direction passage 21*e* and is in communication with the retarded angle chamber R2 through a passage Po in the peripheral direction.

Figure 18:
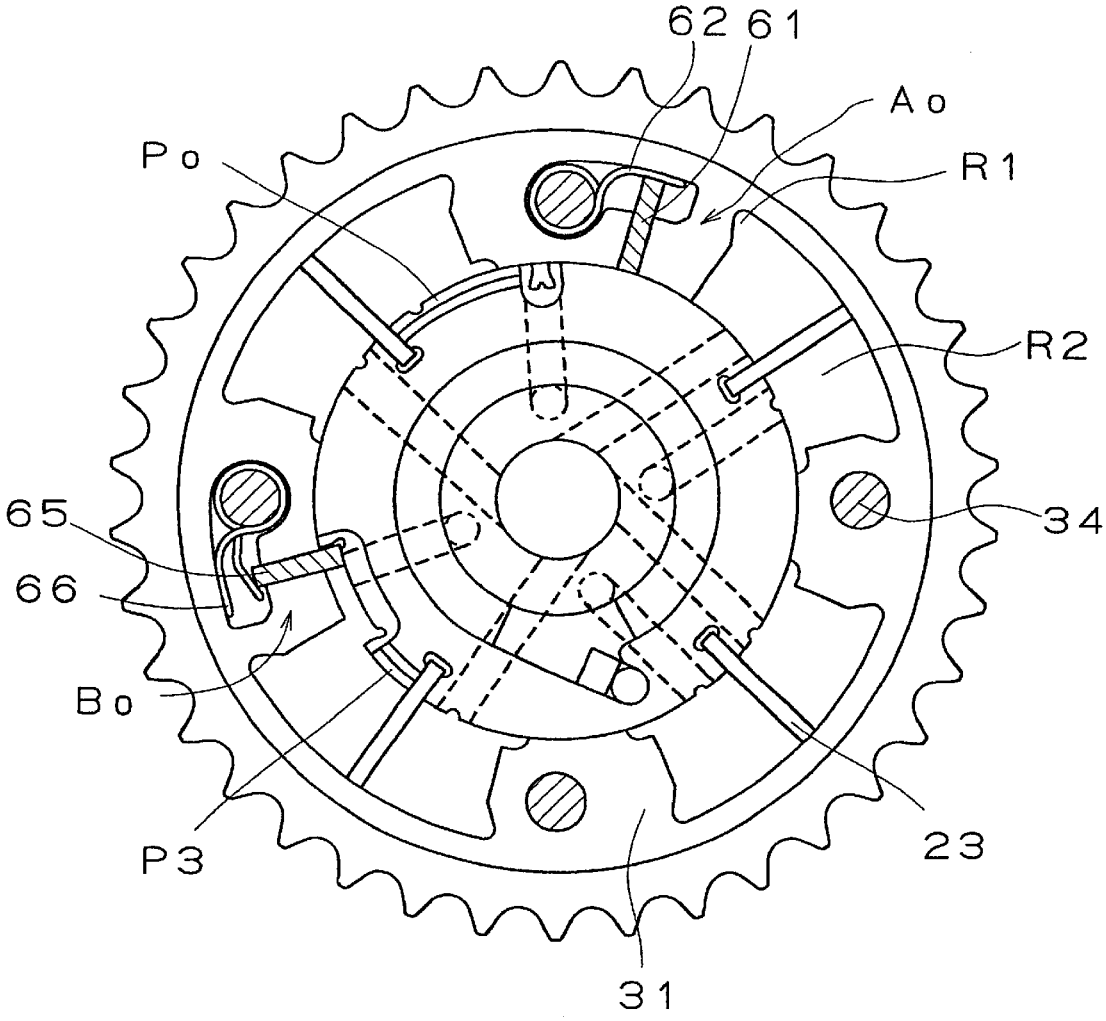
FIG. 18 is a cross-sectional view similar to FIG. 17 illustrating the main rotor rotated to a set phase from a most retarded angle phase relative to the housing body.

The auxiliary controlling mechanism Bo is actuated in response to the operation fluid to be supplied to and discharged from the retarded angle passage 12. The auxiliary controlling mechanism Bo allows the relative rotation of the housing member 30 and the rotor member 20 under the unlock condition, and restricts the rotation of the rotor member 20 only to the retarded angle side relative to the housing member 30 at the set phase (the intermediate advanced angle in the graph of FIG. 20) under the lock condition as shown in FIG. 18. The auxiliary controlling mechanism Bo is provided with the lock plate 65 and the lock spring 66.

The lock plate 65 is slidably movable in the radial direction within the radial retracting groove 31*i* formed in the housing body 31. The lock plate 65 is biased to be projected from the retracting groove 31*i* by the lock spring 66 accommodated in the receiving portion 31*j* of the housing body 31. The receiving portion 31*j* of the housing body 31 is atmospherically open through an open bore (not shown) provided at the rear thin plate 33. Accordingly, smooth movement of the lock plate 65 in the radial direction is assured.

The end portion (radial inner end) of the lock plate 65 is slidably and detachably supported (i.e., can be disposed in and detached from) in the lock groove 21*r* formed in the main rotor 21. Through the supply of operation fluid to the lock groove 21*r*, the lock plate 65 is moved in the radial direction and received in the retracting groove 31*i* by overcoming the biasing force (predetermined as a small value) of the lock spring 66. The end portion of the lock plate 65 can contact the bottom surface of the lock groove 21*r* or the outer periphery of the main rotor 21, and is slidably movable in the peripheral direction under contacting condition.

When the rotor member 20 is positioned at the set phase relative to the housing member 30 as shown in FIG. 18, the end portion on the retarded angle side of the lock groove 21*r* is opposed to the retracting groove 31*i*. The axial end portion of the lock groove 21*r* is formed with the recess portion 21*s* where the operation fluid can be stored. The lock groove 21*r* is in communication with the retarded angle passage 12 through the radial direction passage 21*h* and the axial direction passage 21*e* , and is in communication with the retarded angle chamber R2 directly or through a passage P3 extending in the peripheral direction.

Because the configuration of the fifth embodiment of the present invention is the same as that of the above described first embodiment of the present invention except for the relative rotation controlling mechanism Ao and the auxiliary controlling mechanism Bo, a detailed explanation will not be repeated. Similarly, because the operation of the fifth embodiment is essentially the same as that of the above described first embodiment, except for the difference regarding the position at which the relative rotation controlling mechanism Ao and the auxiliary controlling mechanism Bo function, and because the operation can be readily understood by comparing the two diagrams in FIGS. 20 and 5, a detailed explanation will not be repeated here.

In each of the embodiments of the variable valve timing system described above, the torsion spring S rotatably biases the rotor member 20 to the advanced angle side relative to the housing member 30. However, it is to be understood that the invention can be used without the torsion spring S. A1 so, in each of the embodiments described above, the housing member 30 is integrally rotated with the crankshaft and the rotor member 20 is integrally rotated with the camshaft 10. However, the invention is applicable to another type of variable valve timing system in which the housing member is integrally rotated with the camshaft and the rotor member is integrally rotated with the crankshaft. In this case, the lock phase at which the relative rotation of the housing member and the rotor member is restricted by the relative rotation controlling mechanism is to be defined between the most advanced angle phase and the most retarded angle phase, excluding the most retarded angle phase. In addition, the set phase at which the rotation of the rotor member to the advanced angle side relative to the housing member is restricted by the auxiliary controlling mechanism is to be defined between the most advanced angle phase and the lock phase. This invention can be also used for a variable valve timing system in which the vanes are formed as a unit with the rotor body.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system for an internal combustion engine comprising:

a housing member rotating as a unit with either a crankshaft or a camshaft of the internal combustion engine;

a rotor member relatively rotatably assembled on a shoe portion provided at the housing member and forming an advanced angle chamber and a retarded angle chamber at a vane portion in the housing member, the rotor member rotating as a unit with either the camshaft or the crankshaft of the internal combustion engine;

a relative rotation controlling mechanism actuated in response to supply and discharge of an operation fluid, and allowing relative rotation of the housing member and the rotor member under an unlock condition while restricting relative rotation of the housing member and the rotor member at a lock phase between a most advanced angle phase and a most retarded angle phase, excluding the most retarded angle phase or the most advanced angle phase, under a lock condition;

a fluid pressure circuit controlling the operation fluid to be supplied to and discharged from the advanced angle chamber, the retarded angle chamber, and the relative rotation controlling mechanism; and an auxiliary controlling mechanism actuated in response to the operation fluid supplied to and discharged from the fluid pressure circuit, and allowing the relative rotation of the housing member and the rotor member under the unlock condition, and restricting the rotation of the rotor member to the retarded angle side or to the advanced angle side relative to the housing member at a set phase between the most retarded angle phase or the most advanced angle phase and the lock phase under the lock condition.

2. The variable valve timing system according to claim 1, including a biasing device rotatably biasing the rotor member to the advanced angle side or to the retarded angle side relative to the housing member with a predetermined biasing force.

3. The variable valve timing system according to claim 2, wherein: the biasing device is disposed between the housing member and the rotor member for biasing the rotor member relative to the housing member.

4. The variable valve timing system according to claim 3, wherein the relative rotation controlling mechanism includes a spring and a lock plate slidably positioned in a radially directed retracting groove formed in the housing member.

5. The variable valve timing system according to claim 4, wherein the relative rotation controlling mechanism includes an end portion of the lock plate slidably positionable in a respective lock groove formed in the rotor member.

6. The variable valve timing system according to claim 5, wherein the auxiliary relative rotation controlling mechanism includes a stepped radial inner end of the lock plate.

7. The variable valve timing system according to claim 5, wherein the auxiliary relative rotation controlling mechanism includes a step portion of the lock groove.

8. The variable valve timing system according to claim 1, wherein the auxiliary controlling mechanism is integrally assembled in the relative rotation controlling mechanism.

9. The variable valve timing system according to claim 1, wherein the relative rotation controlling mechanism include s a spring and a lock plate slidably positioned in a radially directed retracting groove formed in the housing member.

10. The variable valve timing system according to claim 9, wherein the relative rotational controlling mechanism includes an end portion of the lock plate slidably positionable in a lock groove formed in the rotor member.

11. The variable valve timing system according to claim 1, wherein the relative rotational controlling mechanism includes a first controlling mechanism that includes a first lock plate slidably positioned in a first radially directed retracting groove formed in the housing member and a first spring biasing the first lock plate, and a second controlling mechanism that includes a second lock plate slidably positioned in a second radially directed retracting groove formed in the housing member and a second spring biasing the second lock plate.

12. The variable valve timing system according to claim 11, wherein an end portion of the first lock plate is slidably positionable in a first lock groove formed in the rotor member, and an end portion of the second lock plate is slidably positionable in a second lock groove formed in the rotor member.

* * * * *